US007047935B2

(12) United States Patent
Arai et al.

(10) Patent No.: US 7,047,935 B2
(45) Date of Patent: May 23, 2006

(54) THROTTLE BODY HAVING INTERNALLY CONNECTED DOUBLE PIPE STRUCTURE

(75) Inventors: Tsuyoshi Arai, Kariya (JP); Naoki Hiraiwa, Toyokawa (JP); Hiroki Shimada, Obu (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 10/901,084

(22) Filed: Jul. 29, 2004

(65) Prior Publication Data

US 2005/0022787 A1 Feb. 3, 2005

(30) Foreign Application Priority Data

Aug. 1, 2003 (JP) ..... 2003-285068

(51) Int. Cl.
*F02D 9/08* (2006.01)

(52) U.S. Cl. ..... 123/337; 123/399

(58) Field of Classification Search ..... 123/337, 123/399, 361

See application file for complete search history.

(56) References Cited

U.S. PATENT DOCUMENTS

| | | | | |
|---|---|---|---|---|
| 5,359,977 | A * | 11/1994 | Abbey | 123/452 |
| 5,704,335 | A | 1/1998 | Akutagawa et al. | |
| 6,295,968 | B1 | 10/2001 | Torii et al. | |
| 2001/0013332 | A1* | 8/2001 | Torii et al. | 123/337 |
| 2002/0152988 | A1* | 10/2002 | Michels | 123/337 |
| 2004/0040536 | A1* | 3/2004 | Suzuki | 123/337 |
| 2004/0041117 | A1* | 3/2004 | Suzuki | 251/305 |
| 2004/0154586 | A1* | 8/2004 | Ino et al. | 123/337 |
| 2004/0187844 | A1* | 9/2004 | Torii et al. | 123/337 |

FOREIGN PATENT DOCUMENTS

| | | |
|---|---|---|
| JP | 9-032590 | 2/1997 |
| JP | 10-047520 | 2/1998 |
| JP | 11-132061 | 5/1999 |
| JP | 2001-263098 | 9/2001 |
| JP | 2001-303983 | 10/2001 |

* cited by examiner

*Primary Examiner*—John T. Kwon
(74) *Attorney, Agent, or Firm*—Nixon & Vanderhye PC

(57) ABSTRACT

A resinous throttle body has a bore wall part having a double pipe structure constructed with a bore inner pipe and a bore outer pipe that are connected with each other via an annular connecting part. The annular connecting part has axial board thickness set to be less than the minimum radial thickness of a portion of the bore inner pipe and a portion of the bore outer pipe that are located around the annular connecting part. Therefore, the annular connecting part can be formed to be in a thin-walled radially elongated plate shape. The annular connecting part has a radially cross-sectional length larger than its axial board thickness, so that rigidity and strength of the annular connecting part is decreased. Therefore, contraction of the bore outer pipe occurred in its molding process does not largely affect the bore inner pipe, so that a cylindrical-shaped inner periphery of the bore inner wall, which rotatably receives a disc-shaped throttle valve, can be restricted from being deformed.

13 Claims, 15 Drawing Sheets

THROTTLE BODY HAVING INTERNALLY CONNECTED DOUBLE PIPE STRUCTURE

CROSS REFERENCE TO RELATED APPLICATION

This application is based on and incorporates herein by reference Japanese Patent Application No. 2003-285068 filed on Aug. 1, 2003.

FIELD OF THE INVENTION

The present invention relates to a throttle body including a bore wall part having a double-pipe structure formed with a substantially cylindrical-shaped bore inner pipe, a substantially cylindrical-shaped bore outer pipe and an annular connecting part that are integrally molded of a resinous material. Especially, the present invention relates to an electrically controlled throttle apparatus, in which a motor is driven to control a rotation angle of a throttle valve that is rotatably received in the throttle body. Thus, an amount of intake air flowing into an internal combustion engine is controlled in accordance with an operating amount of a driver in a vehicle.

BACKGROUND OF THE INVENTION

Conventionally, a drive unit such as a motor is used in an electrically controlled throttle apparatus to control a throttle valve to be in a predetermined throttle position in accordance with an accelerator position of an accelerator pedal stepped by a driver. According to an electrically controlled throttle apparatus disclosed in JP-A 10-047520, JP-A 2001-263098 and JP-A 2001-303983, a bore wall part and a motor housing part are integrally molded of a resinous material to construct a throttle body. Besides, according to JP-A 09-032590 and JP-A 11-132061, a throttle body has an outer pipe and an inner pipe that are coaxially arranged with each other to form an integrally molded double-pipe structure, in which the inner pipe receives a throttle valve.

The electrically controlled throttle apparatus drives a motor to control a throttle position of a throttle valve in accordance with an operating amount of a driver. In this throttle apparatus, circularity of an inner periphery of the substantially cylindrical bore wall part of the resinous throttle body has a large influences with an airtightness of the throttle valve, when the throttle valve is in its full close position. Besides, when the substantially cylindrical bore wall part, a substantially cylindrical valve bearing part and a substantially cylindrical motor housing part are integrally molded of a resinous material, contraction may arise in the valve bearing part and the motor housing part during its molding process. Accordingly, the inner periphery of the bore wall part is apt to be deformed due to the contraction of the valve bearing part and the motor housing part.

FIGS. 13 and 14 are perspective views showing an example of a throttle apparatus. The throttle apparatus has a throttle body 100 that is integrally molded of a resinous material with a substantially cylindrical valve bearing part 103, a substantially cylindrical motor housing part 104 and a bore wall part 105. The valve bearing part 103 rotatably supports one end side of the throttle shaft 102 that integrally rotates with a throttle valve 101. The motor housing part 104 receives a driving motor that rotates the throttle shaft 102 and the throttle valve 101 integrally. The bore wall part 105 internally forms an air intake passage, through which intake air flows into an internal combustion engine. The bore wall part 105 has a double pipe structure, in which a bore inner pipe 107 is coaxially arranged inside a bore outer pipe 106. The outer periphery of the bore inner pipe 107 and the inner periphery of the bore outer pipe 106 are connected with each other via an annular connecting part 109.

FIG. 15 is a partially cross-sectional perspective view showing the throttle apparatus. The bore wall part 105 having a double pipe structure is integrally molded of a resinous material. The annular connecting part 109 may has radial thickness that is less than its board thickness (axial board thickness) in its axial direction. The annular connecting part 109 has axial board thickness that may be greater than radial thickness of the bore inner pipe 106. In these cases, contraction of the bore outer pipe 106 in its molding process may cause deformation of the inner periphery of the bore inner pipe 107. Alternatively, the valve bearing part 103 and the sidewall of the bore outer pipe 106 may be directly connected with each other. In this connecting structure, contraction of a portion in the bore outer pipe 106 around the valve bearing part 103 may cause deformation of the inner periphery of the bore inner pipe 107. Alternatively, the sidewall of the motor housing part 104 and the sidewall of the bore outer pipe 106 may be directly connected with each other. In this connecting structure, contraction of a portion around the motor housing part 104 may cause deformation of the inner periphery of the bore inner pipe 107. Accordingly, when the motor housing part 104, the valve bearing part 103 and the bore wall part 105 are integrally molded of a resinous material, circularity of the inner periphery of the bore inner pipe 107 may be degraded due to contraction of the bore outer pipe 106 and the motor housing part 104. In this case, interference may arise between the throttle valve 101 and the bore inner pipe 107 when the throttle valve 101 rotates from its full close position to its full open position. Furthermore, a gap, which is formed between the inner periphery of the bore inner pipe 107 and the outer circumferential periphery of the throttle valve 101 when the throttle valve 101 is in its full close position, may become larger than a predetermined amount. Accordingly, airtightness may be degraded when the throttle valve 101 is in its full close position, and leakage of intake air increases in an idling operation of the engine.

SUMMARY OF THE INVENTION

It is an object of the present invention to provide a throttle body including both of a bore inner pipe and a bore outer pipe connected with each other via an annular connecting part having a shape restricting deformation of the inner periphery of the bore inner pipe caused by contraction of at least the bore outer pipe. It is another object of the present invention to provide a throttle body, in which the inner periphery of the bore inner pipe can be restricted from deformation caused by contraction of the bore outer pipe or the motor housing part. Thus, the throttle valve can be restricted from occurrence of a failure, and airtightness of the throttle apparatus can be maintained when the throttle valve is in the full close position.

According to the present invention, a throttle body, which receives a throttle valve, includes a bore wall part having a double-pipe structure. The bore wall part includes an inner pipe, an outer pipe and an annular connecting part. The inner pipe rotatably receives the throttle valve. The outer pipe is arranged on a radially outer side of the inner pipe to define a cylindrical space with an outer periphery of the inner pipe therebetween. The annular connecting part connects the inner pipe and the outer pipe, such that the annular connecting part partitions and blocks substantially entirely over a circumferential area of the cylindrical space defined between the bore inner pipe and the bore outer pipe.

The inner pipe, the outer pipe and the annular connecting part are integrally molded of a resinous material. The axial thickness of the annular connecting part is less than the minimum thickness of the inner pipe in its radial direction and the minimum thickness of the outer pipe in its radial direction. Alternatively, the axial thickness of the annular connecting part is less than its radial thickness. The annular connecting part partially blocks substantially entirely over the circumferential area of the cylindrical space formed between the inner pipe and the outer pipe. The inner pipe of the bore wall part has a substantially cylindrical inner periphery that defines an intake air passage through which intake air passes. The throttle valve opens and closes the intake air passage defined by the inner periphery of the inner pipe of the bore wall part.

An integrally molding method of a throttle body of a resinous material includes clamping the molding dies, injecting molten filler, and applying predetermined pressure to the filler. The molding dies are clamped with each other during a first clamping process. Molten filler is injected into molding dies clamping with each other to fill a first cavity having an internal volume greater than a volume of the molded throttle body defined in the molding dies during an injection-filling process. Predetermined pressure is applied to the filler filled in the molding dies during a pressure holding process. The thickness of the annular connecting part in an axial direction of the annular connecting part becomes greater than the minimum thickness of the inner pipe in its radial direction and the minimum thickness of the outer pipe in its radial direction. The first clamping process is performed during at least one of the injection-filling process and the pressure holding process. The molding method of the throttle body includes steps of cooling the filler, and refilling molten filler. The filler, to which the predetermined pressure is applied, is cooled during the pressure holding process, and molten filler is refilled into the first cavity by an amount, which is equivalent to a reduced volume of the cooled filler contracted by the cooling, during the pressure holding process. The molding dies clamp with each other to define a second cavity that has an internal volume substantially the same as the volume of the molded throttle body.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
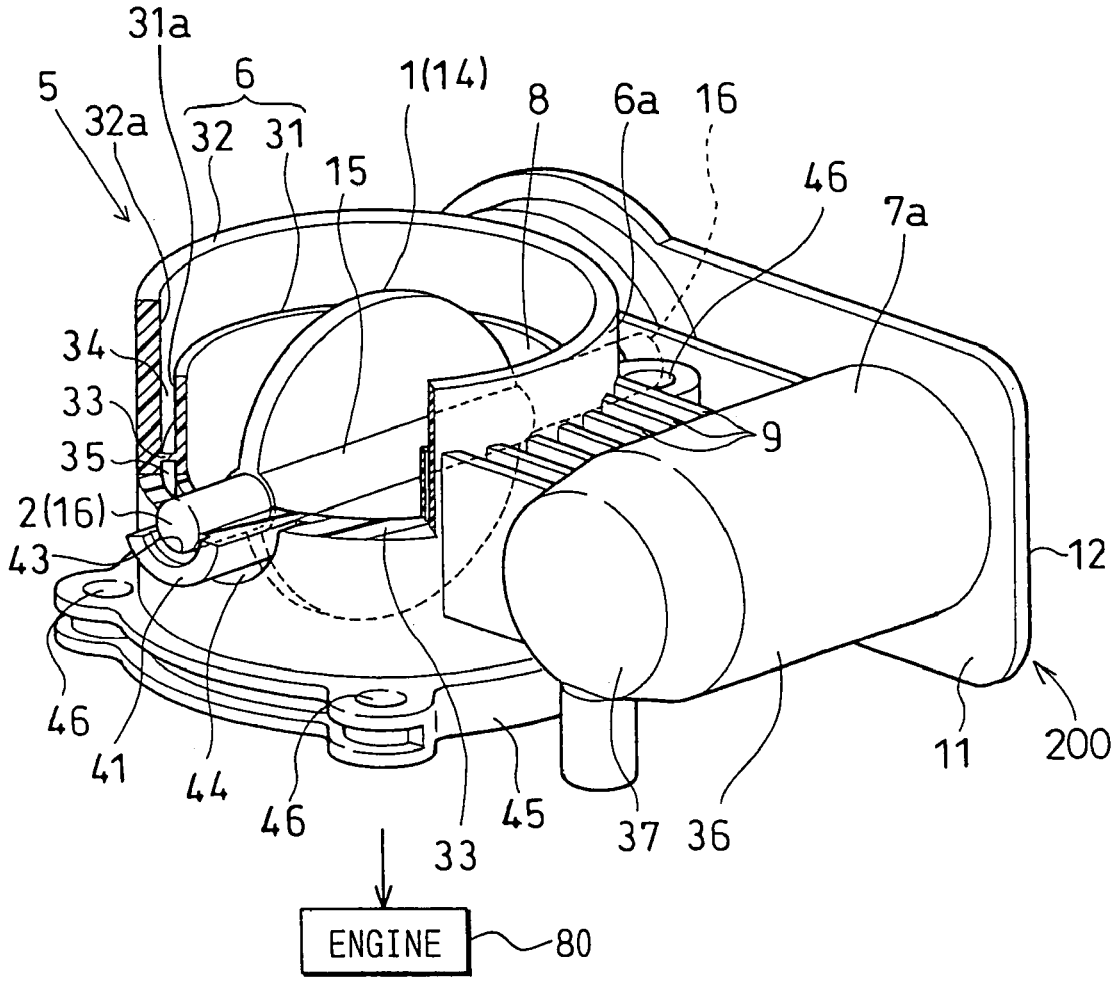
FIG. 1 is a perspective partially cross-sectional view showing an electrically controlled throttle apparatus according to a first embodiment of the present invention.
Figure 2:
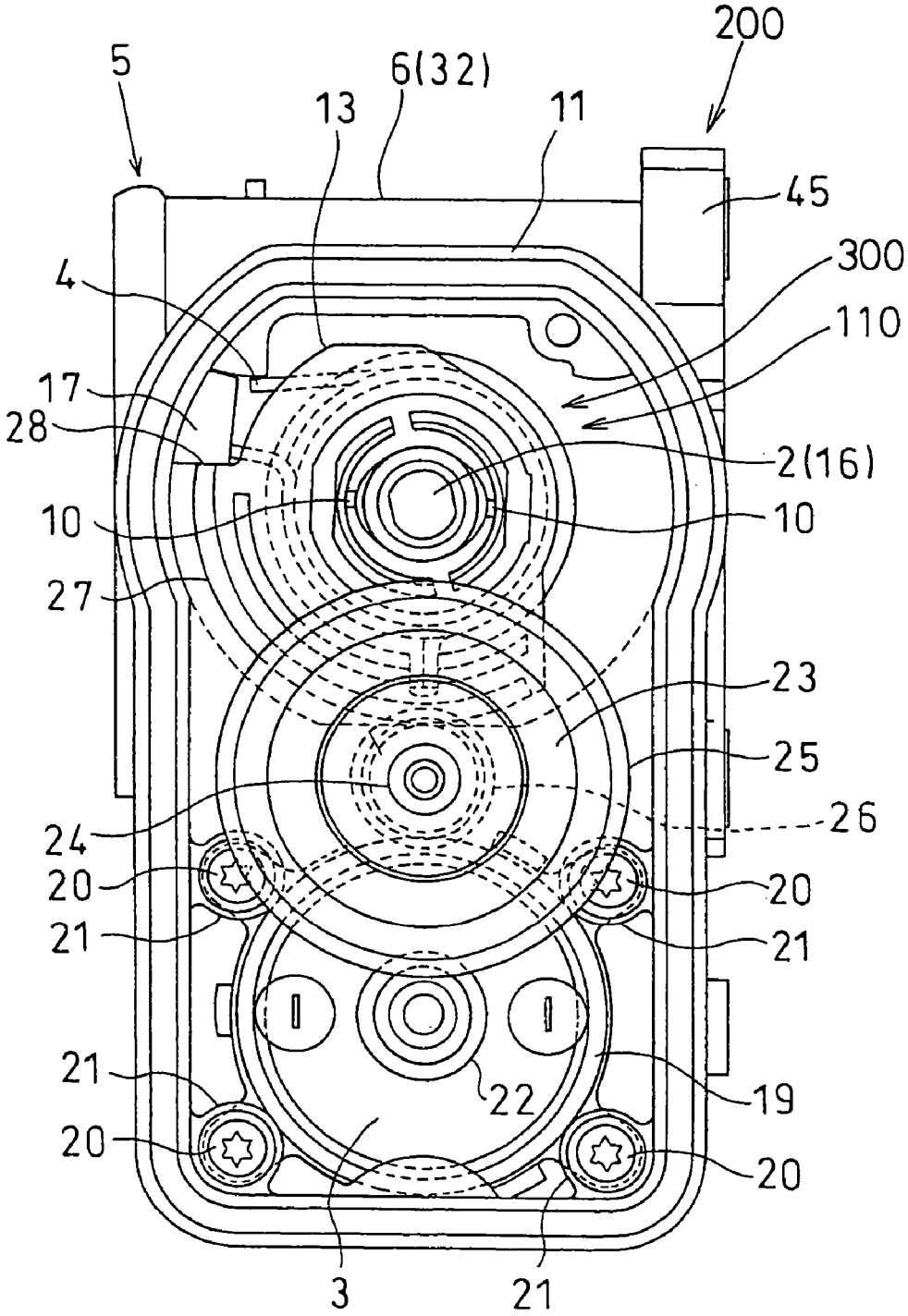
FIG. 2 is a front view showing components received in a gearbox of a throttle body provided in the electrically controlled throttle apparatus.
Figure 3:
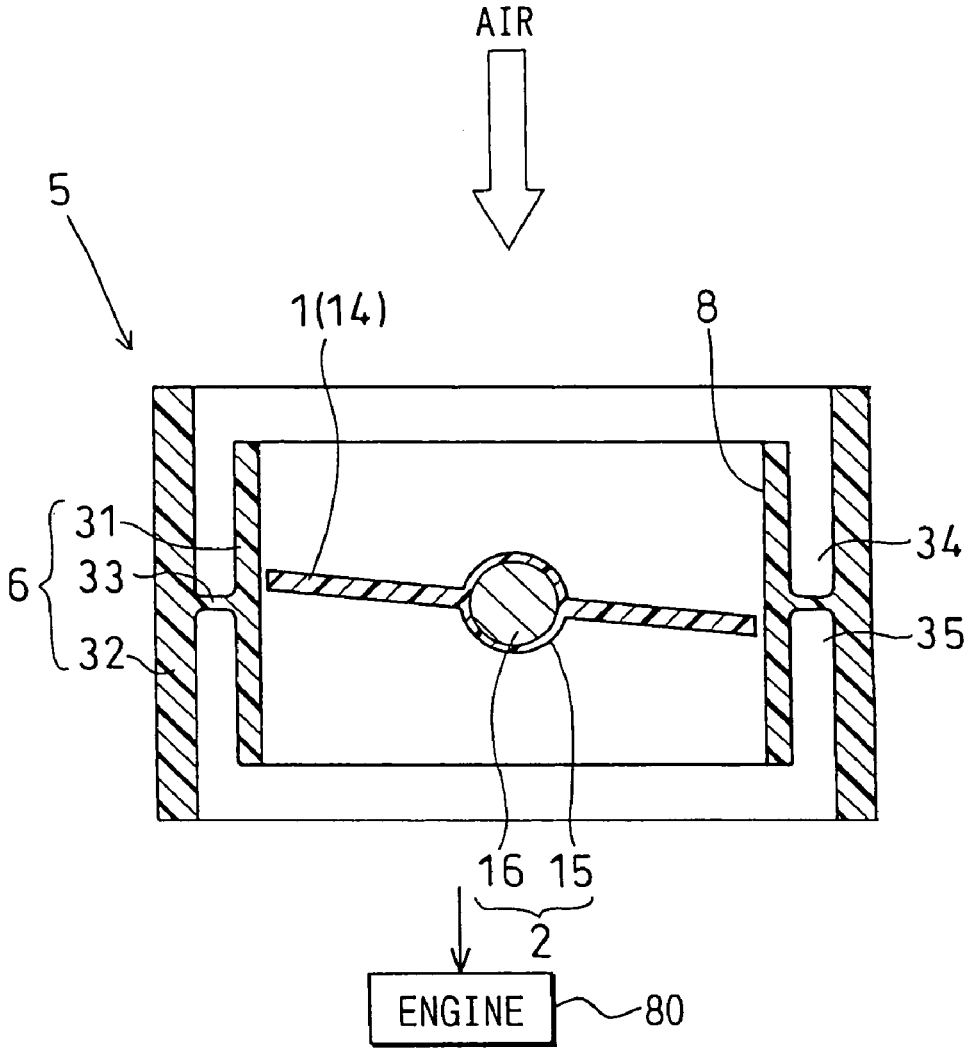
FIG. 3 is a schematic cross-sectional side view showing a double-pipe structure of a bore wall part provided in the throttle body.

As shown in FIGS. 1 to 3, an electrically controlled throttle apparatus is constructed with a throttle valve 1, a throttle shaft 2, a driving motor 3, a coil spring 4, reduction gears 300, an actuator case 200, a throttle body 5 and an ECU (electronic control unit). The throttle valve 1 controls an amount of intake air flowing into an internal combustion engine 80. The throttle shaft 2 constructs a shaft part of the throttle valve 1. The driving motor 3 rotates the throttle shaft 2, so that the throttle valve 1 is rotated in an open direction, in which the throttle valve 1 is opened to be in a full throttle position (full open position), or a close direction, in which the throttle valve 1 is closed to be in an idling position (full close position). The driving motor 3 serves as an actuator (valve operating means). The coil spring 4 urges the throttle shaft 2, so that the throttle valve 1 is rotated in the close direction. The reduction gears (power transmission unit) 300 transmit rotation power of the driving motor 3 to the throttle shaft 2 in order to integrally rotate the throttle shaft 2 and the throttle valve 1. The actuator case 200 rotatably receives the reduction gears 300. The throttle body 5 internally forms an air intake passage introducing intake air into each cylinders of the engine 80. The ECU (electronic control unit) electrically controls the driving motor 3. The ECU is connected to an accelerator position sensor (not shown) that converts an operation degree (accelerator operation amount) of an accelerator pedal stepped by a driver into an electronic signal (accelerator position signal) in order to output the accelerator position signal to the ECU. The accelerator position signal represents the accelerator operation amount. The electrically controlled throttle apparatus has a throttle position sensor 110 that converts an opening degree of the throttle valve 1 into an electronic signal (throttle position signal) in order to output the throttle position signal to the ECU. The throttle position signal represents an opening degree of the throttle valve 1. The ECU performs PID (proportional, integral and differential [derivative]) feedback control with respect to the driving motor 3 in order to eliminate deviation between the throttle position signal transmitted from the throttle position sensor 110 and the accelerator position signal transmitted from the accelerator position sensor.

The throttle position sensor 110 is constructed with permanent magnets 10, yokes (not shown), a hall element (not shown), a terminal (not shown), a stator (not shown) and the like. The permanent magnets 10 are separated rectangular magnets used for generating a magnetic field. The yokes are constructed with separated substantially arc-shaped pieces, and are magnetized by the permanent magnets 10. The hall element is integrally provided with a sensor cover (FIG. 13) 12 to be opposed to the separated permanent magnets 10. The terminal is constructed with a conductive metallic thin plate that connects the hall element to the ECU, which is externally provided with respect to the throttle position sensor 110. The stator is made of a ferrous metallic material for concentrating magnetic flux into the hall element. The separated permanent magnets 10 and the separated yokes are secured to the inner periphery of a valve gear 13, which constructs the reduction gears 300, using glue or the like.

The throttle valve 1 is a butterfly-type rotary valve for controlling an amount of intake air introduced into the engine 80. The throttle valve 1 having a substantially disc shape is integrally molded with the outer periphery of a valve supporting portion of the throttle shaft 2, so that the throttle valve 1 and the throttle shaft 2 can integrally rotate. The throttle valve 1 is made of a thermo stable resinous material, such as PPS (poly phenylene sulfide), PBTG30 (poly butylene terephthalate including grass fiber by 30%), PA (polyamide), PP (polypropylene) or PEI (polyether imide). A stiffening rib (not shown) is integrally molded on one plane face, e.g., upstream side of the intake airflow direction with respect to the resinous disc part (disc-shaped part) 14, or both plane faces of the disc-shaped part 14 of the throttle valve 1 for reinforcing the disc-shaped part 14.

Both of the end sides of the throttle shaft 2 are rotatably supported by a first valve bearing 41 and a second valve bearing (not shown) of the throttle body 5 to be slidable each other. The axial direction of the throttle shaft 2 is arranged to be substantially perpendicular to the central axial direction of the bore wall part 6 of the throttle body 5, and is arranged to be substantially in parallel with the central axial direction of a substantially cylindrical shaped motor housing part 7. Here, the throttle shaft 2 is constructed with a resinous shaft part 15 and a metallic shaft part 16, in this embodiment. The resinous shaft part 15 serves as a valve supporting portion for supporting the throttle valve 1. The metallic shaft part 16 is formed inside of the resinous shaft part (cylindrical part) 15 by insert molding to reinforce the resinous shaft part 15.

The resinous shaft part 15 is formed in a substantially cylindrical shape. The resinous shaft part 15 is made of a thermo stable resinous material, such as PPS, PBTG30, PA, PP or PEI, as well as the resinous disc part 14 of the throttle valve 1. The metallic shaft part 16 is formed in a round-bar shape, and is made of a metallic material such as stainless steel. One end portion of the metallic shaft part 16 of the throttle shaft 2 on the left side end in FIG. 1 exposes to the outer peripheral side of the throttle shaft 2 in order to serve as a first bearing sliding part that rotatably slides with respect to the first valve bearing 41 of the throttle body 5. The valve gear 13 constructing the reduction gears 300 is integrally provided on the other end portion of the metallic shaft part 16 of the throttle shaft 2 on the right side end in FIG. 1. The other end side of the resinous shaft part 15 of the throttle shaft 2 on the right side end in FIG. 1 exposes to the outer peripheral side of the throttle shaft 2 in order to serve as a second bearing sliding part (not shown) that rotatably slides with respect to a second valve bearing (not shown) of the throttle body 5.

The actuator case 200 is constructed with a gearbox part (gear housing part, case body) 11 and a sensor cover (gear cover, cover) 12. The gearbox part 11 is integrally molded with an outer periphery of the bore wall part 6 of the throttle body 5 of the resinous material. The sensor cover 12 supports the hall element of the throttle position sensor 110, the terminal and the stator. The sensor cover 12 covers the opening side of the gearbox part 11.

The gearbox part 11 is made of the same resinous material as that of the bore wall part 6, and is molded in a predetermined shape to construct a gear chamber that rotatably receives the reduction gears 300. A full-close stopper 17 is integrally molded with the inner wall of the gearbox part 11 of the resinous material, for restricting rotation of the throttle valve 1 at the idling position, i.e., full close position of the throttle valve 1. Here, a full-open stopper may be integrally molded with the inner wall of the gearbox part 11 for restricting rotation of the throttle valve 1 at the full-throttle position, i.e., full open position of the throttle valve 1.

The sensor cover 12 is formed in a predetermined shape using a resinous material such as thermo plastic, in order to electrically insulate between terminals of the throttle position sensor 110 and power-supply terminals of the driving motor 3. The sensor cover 12 has an engaging part that engages with a corresponding engaged part, which is formed on the opening side of the gearbox part 11 of the throttle body 5, each other. The engaging part of the sensor cover 12 and the engaged part of the gearbox part 11 are connected using a rivet, a screw (not shown), or are thermally swaged with each other, for example. A substantially cylindrical shaped receptacle 18 (FIG. 13) is integrally molded with the sensor cover 12 to be connected with an electrical connector (not shown).

The driving motor 3 is an electrically driven actuator integrally connected with the power-supply terminals that is provided in the sensor cover 12 or the substantially cylindrical shaped motor housing part 7. When the driving motor 3 is energized, its motor shaft (not shown) is rotated in its forward direction or in its reverse direction. The driving motor 3 has a front-end frame 19 screwed onto a protrusion 21 that is provided in the motor housing part 7 or the gearbox part 11 using a fastening member 20 such as a screw. Thus, the driving motor 3 is received in the motor housing part 7. A cushion member such as a blade spring can be provided between a rear-end frame of the driving motor 3 and a bottom wall surface of the motor housing part 7 in order to insulate the driving motor 3 from vibration of the engine 80. Another cushion member can be provided between an end yoke (not shown) of the driving motor 3 and a bottom wall surface of the motor housing part 7. Alternatively, an insulation member can be provided instead of the cushion member for enhancing vibration resistant performance of the driving motor 3.

The reduction gears 300 reduce rotation speed of the driving motor 3 by a predetermined reduction gear ratio. The reduction gears 300 (valve driving means, power transmission unit) is constructed with a pinion gear 22, a middle reduction gear 23 and the valve gear 13 for driving the throttle shaft 2 that rotates the throttle valve 1. The pinion gear 22 is secured to the outer periphery of the motor shaft of the driving motor 3. The middle reduction gear 23 engages with the pinion gear 22 to be rotated by the pinion gear 22. The valve gear 13 engages with the middle reduction gear 23 to be rotated by the middle reduction gear 23.

The pinion gear 22 is made of a metallic material, and is integrally formed with the motor shaft of the driving motor 3 to be in a predetermined shape, so that the pinion gear 22 serves as a motor gear that integrally rotates with the motor shaft of the driving motor 3. The middle reduction gear 23 is formed to be in a predetermined shape of a resinous material, and is rotatably provided onto the outer periphery of the supporting shaft 24 that serves as a rotation center of the middle reduction gear 23. The middle reduction gear 23 is constructed with a large gear part 25, which engages with the pinion gear 22 of the motor shaft, and a small gear part 26 that engages with the valve gear 13. The supporting shaft 24 is integrally molded with the bottom wall of the gearbox part 11 of the throttle body 5. An end part of the supporting shaft 24 engages with a recess portion formed in the inner wall of the sensor cover 12.

The valve gear 13 is integrally molded to be in a predetermined substantially cylindrical shape of a resinous material. Gear teeth (teeth part) 27 are integrally formed in the outer periphery of the valve gear 13 to engage with the small gear part 26 of the middle reduction gear 23. A cylindrical part (not shown) is integrally molded with the valve gear 13 on the side of the bore wall part 6 to protrude in the left direction in FIG. 1. The outer periphery of the cylindrical part (spring inner periphery guide) of the valve gear 13 supports the diametrically inner periphery of the coil spring 4. A full-close stopper portion 28 is integrally formed with the valve gear 13 on one circumferentially end plane in the outer periphery of the valve gear 13, i.e., the gear teeth 27. The full-close stopper portion 28 hooks to the full-close stopper 17 of the gearbox part 11, when the throttle valve 1 is in the idling position, i.e., full close position.

The coil spring 4 is provided on the outer peripheral side of the metallic shaft part 16 of the throttle shaft 2. One end part of the coil spring 4 on the left side in FIG. 1 is supported by a body side hook (not shown) provided on the outer wall 6*a* of the bore wall part 6 of the throttle body 5, i.e., bottom wall of the gearbox part 11. The other end part of the coil spring 4 on the right side in FIG. 1 is supported by a gear side hook (not shown) provided on a plane of the valve gear 13 that is located on the side of the bore wall part 6.

The throttle body 5 is a throttle housing that includes the substantially cylindrical-shaped bore wall part 6 internally forming a circular-shaped intake passage, through which intake air flows into the engine 80. The bore wall part 6 internally receives the disc-shaped throttle valve 1, such that the throttle valve 1 can open and close the circular-shaped intake passage of the bore wall part 6. The bore wall part 6 rotatably receives the throttle valve 1 in the intake passage (bore), such that the throttle valve 1 can rotate from the full close position to the full open position. The throttle body 5 is screwed onto an intake manifold of the engine 80 using a fasting bolt or a screw (not shown).

As shown in FIG. 3, the bore wall part 6 of the throttle body 5 is formed in a predetermined shape that has a double-pipe structure, in which a substantially cylindrical-shaped bore outer pipe 32 is arranged on the diametrically outer side of a substantially cylindrical-shaped bore inner pipe 31. The bore inner pipe 31 is an internal side cylindrical part that forms an internal periphery. The bore outer pipe 32 is an external side cylindrical part that forms an outer member. The bore wall part 6 of the throttle body 5 is made of a thermo stable resinous material, such as PPS, PBTG30, PA, PP or PEI. The bore inner pipe 31 and the bore outer pipe 32 have an intake-air inlet part (air intake passage) and an intake-air outlet part (air intake passage). Intake air drawn from an air cleaner (not shown) passes through an intake pipe (not shown), the intake-air inlet part and the intake-air outlet part of the bore wall part 6. Subsequently, the intake air flows into a surge tank of the engine 80 or the intake manifold. The bore inner pipe 31 and the bore outer pipe 32 are integrally molded with each other. The bore inner pipe 31 and the bore outer pipe 32 have a substantially the same inner diameter and a substantially the same outer diameter along with the intake airflow direction, i.e., the direction from the upper side to the lower side in the vertical direction of FIG. 1.

The motor housing part 7, which receives the driving motor 3, is integrally molded of the resinous material with the bore wall part 6 via plural plate-shaped connecting members 9 to construct the throttle body 5. The motor housing part 7 is arranged in parallel with the bore wall part 6. That is, the motor housing part 7 is in parallel with the bore wall part 6 with respect to the gearbox part 11 in the throttle body 5. The motor housing part 7 is arranged on the radially outer side of the sidewall face 6*a* of the bore outer pipe 32 of the bore wall part 6 having the double-pipe structure, with respect to the central axial direction of the bore wall part 6. The motor housing part 7 is integrally molded of the resinous material with the gearbox part 11. Specifically, the motor housing part 7 is integrally molded with the end face of the gearbox part 11 located on the left side in FIG. 1. The gearbox part 11 has a chamber for rotatably receiving the reduction gears 300. The motor housing part 7 has a substantially cylindrical sidewall part 41 and a substantially circular shaped bottom wall part 42. The sidewall part 41 extends from the left side face of the gearbox part 11 in the left direction in FIG. 1. The bottom wall part 42 plugs the opening side of the sidewall part 41 on the left side in FIG. 1. The central axis of the sidewall part 41 of the motor housing part 7 is arranged substantially in parallel with the axis of the throttle shaft 2, i.e., rotation axis of the throttle valve 1. Besides, the central axis of the sidewall part 41 of the motor housing part 7 is arranged substantially perpendicularly to the central axis of the bore inner pipe 31 of the bore wall part 6.

The plural plate-shaped connecting members 9, which has a rib structure, are integrally molded of the resinous material with the bore outer pipe 32 of the bore wall part 6 and the motor housing part 7. The plural plate-shaped connecting members 9 protrude from the sidewall face 6*a* of the bore outer pipe 32 of the bore wall part 6, and connect to the sidewall face 7*a* of the sidewall part 36 of the motor housing part 7. Each of the plural plate-shaped connecting members 9 has flat faces on its both sides in a direction substantially perpendicular to the central axis of the bore outer pipe 32 of the bore wall part 6. Each of the flat faces of the plural plate-shaped connecting members 9 has substantially the same width and substantially the same length with respect to each other.

The plural plate-shaped connecting members 9 are arranged, such that the thickness direction of the plural plate-shaped connecting members 9 becomes substantially perpendicular to the central axis of the bore outer pipe 32 of the bore wall part 6. Besides, plural plate-shaped connecting members 9 are arranged substantially in parallel with each other in the direction that is substantially perpendicular to the central axis of the bore outer pipe 32 of the bore wall part 6.

The bore inner pipe 31 internally has an air intake passage, through which intake air flows to the engine 80. The throttle valve 1 and the throttle shaft 2 are rotatably provided in the air intake passage of the bore inner pipe 31. A cylindrical space (annular space) is formed between the bore inner pipe 31 and the bore outer pipe 32, and the cylindrical space is circumferentially blocked, i.e., partitioned, by an annular connecting part 33 at a substantially longitudinally central section thereof. For instance, the substantially longitudinally central section of the cylindrical space is a section along with a circumferential direction of the throttle valve 1 in the full close position. Namely, the substantially longitudinally central section is a circumferential section of the bore wall part 6 passing through the axial center of the throttle shaft 2. The annular connecting part 33 connects the outer periphery 31*a* of the bore inner pipe 31 and the inner periphery 32*a* of the bore outer pipe 32, such that the annular connecting part 33 blocks substantially entirely over the circumferential area of the cylindrical space formed between the bore inner pipe 31 and the bore outer pipe 32.

In this embodiment, wall thickness, i.e. board thickness (axial board thickness) of the annular connecting part 33 in its axial direction is set to be less than a minimum radial thickness of a portion of the bore inner pipe 31 around the annular connecting part 33. Besides, wall thickness of the annular connecting part 33 in its axial direction is set to be less than a minimum radial thickness of a portion of the bore outer pipe 32 around the annular connecting part 33. Besides, the axial board thickness of the annular connecting part 33 is set to be less than a radial thickness, i.e. radial wall thickness of the annular connecting part 33. Furthermore, radial thickness of the bore outer pipe 32 is set to be greater than the radial thickness of the bore inner pipe 31.

The cylindrical space between the bore inner pipe 31 and the bore outer pipe 32 located on the axially upstream side with respect to the annular connecting part 33 serves as a blockade recess part (moisture trapping groove) 34 for blocking moisture flowing along with the inner periphery of the intake pipe toward the intake manifold. The cylindrical space between the bore inner pipe 31 and the bore outer pipe 32 located on the axially downstream side with respect to the annular connecting part 33 serves as a blockade recess part (moisture trapping groove) 35 for blocking moisture flowing along with the inner periphery of the intake manifold.

Referring back to FIG. 1, the bore inner pipe 31 and the bore outer pipe 32 has the substantially cylindrical first valve bearing 41 and the substantially cylindrical second valve bearing (not shown) that are integrally molded of a resinous material. The first valve bearing 41 rotatably supports the first bearing sliding part of the metallic shaft part 16 of the throttle shaft 2 via a dry bearing (not shown). The second valve bearing rotatably supports the second bearing sliding part of the resinous shaft part 15 of the throttle shaft 2. A circular-shaped first shaft hole 43 is formed in the first valve bearing 41, and a circular-shaped second shaft hole (not shown) is formed in the second valve bearing. The second valve bearing is integrally molded with the outer wall 6*a* of the bore wall part 6, i.e., bottom wall of the gearbox part 11 of the throttle body 5, to be protruded in the right direction in FIG. 1. The outer periphery of the second valve bearing serves as a spring inner periphery guide (not shown) for supporting the diametrically inner periphery of the coil spring 4.

In this embodiment, the first valve bearing 41 is connected to the inner periphery 32*a* of the bore outer pipe 32 via the bore inner pipe 31 and the annular connecting part 33. The first valve bearing 41 is integrally molded of a resinous material with the outer periphery 31*a* of the bore inner pipe 31. The first valve bearing 41 protrudes from the outer periphery 31*a* of the bore inner pipe 31 in a direction substantially in parallel with the rotation center of the throttle valve 1, i.e., axial direction of the throttle shaft 2. A substantially annular recess 44 is formed around the first valve bearing 41 in the circumferential outer periphery of the outer wall 6*a* of the bore outer pipe 32. A plug (not shown) is provided on the first valve bearing 41 for plugging the opening side of the first valve bearing 41. The second valve connecting part may be connected to the inner periphery 32*a* of the bore outer pipe 32 via the bore inner pipe 31 and the annular connecting part 33. Another substantially annular recess may be formed around the second valve bearing.

A stay part 45 is integrally molded of the resinous material on the outer periphery, i.e., outer wall 6*a* of the bore outer pipe 32. The stay part 45 is connected with a connecting end face of the intake manifold of the engine 80 using a fastening member such as a bolt (not shown), when the throttle body 5 is mounted on the engine 80. The stay part 45 is provided on the outer wall 6*a* of the bore outer pipe 32 located on the lower end side in FIG. 1. The stay part 45 radially outwardly protrudes from the surface of the outer wall 6*a* of the bore outer pipe 32, and has an insertion hole 46 through which the fastening member such as the bolt passes.

As follows, an operation of the electrically controlled throttle apparatus is described. When the driver steps the accelerator pedal of the vehicle, the accelerator position signal, which is transmitted from the accelerator position sensor to the ECU, changes. The ECU controls electric power supplied to the driving motor 3, so that the motor shaft of the driving motor 3 is rotated and the throttle valve 1 is operated to be in a predetermined position. The torque of the driving motor 3 is transmitted to the valve gear 13 via the pinion gear 22 and the middle reduction gear 23. Thus, the valve gear 13 rotates by a rotation angle corresponding to the stepping degree of the accelerator pedal, against urging force generated by the coil spring 4. Therefore, the valve gear 13 rotates, and the throttle shaft 2 also rotates by the same angle as the rotation angle of the valve gear 13, so that the throttle valve 1 rotates from its full close position toward its full open position in the open direction. As a result, the air intake passage formed in the bore inner pipe 31 of the bore wall part 6 of the throttle body 5 is opened by a predetermined degree, so that rotation speed of the engine 80 is changed to be a rotation speed corresponding to the stepped degree of the accelerator pedal by the driver.

By contrast, when the driver releases the accelerator pedal, the throttle valve 1, the throttle shaft 2, the valve gear 13 and the like return to an initial position of the throttle valve 1 by urging force of the coil spring 4. The initial position of the throttle valve 1 is an idling position or the full close position. Alternatively, when the driver releases the accelerator pedal, the value of the accelerator position signal transmitted by the accelerator position sensor becomes substantially 0%. Therefore, in this situation, the ECU can supply electric power to the driving motor 3 in order to rotate the motor shaft of the driving motor 3 in its reverse direction, so that the throttle valve 1 is controlled at its full close position. In this case, the throttle valve 1 can be rotated in the close direction by the driving motor 3.

The throttle valve 1 rotates in the close direction by urging force of the coil spring 4 until the full-close stopper portion 28 provided on the valve gear 13 contacts the full-close stopper 17 integrally molded on the inner wall of the gearbox part 11 of the throttle body 5. Here, the close direction is a direction, in which the throttle valve 1 closes the air intake passage by rotating from the full open position to the full close position. Rotation of the throttle valve 1 is restricted by the full-close stopper 17 at the full close position of the throttle valve 1. Therefore, the throttle valve 1 is maintained in the predetermined full close position, i.e., idling position, in the air intake passage formed in the bore inner pipe 31 of the bore wall part 6 of the throttle body 5. Thus, the air intake passage connected to the engine 80 is substantially closed, so that rotation speed of the engine 80 is set at a predetermined idling speed.

In the electrically controlled throttle apparatus, the bore wall part 6 of the throttle body 5 has a double pipe structure. The axial board thickness of the annular connecting part 33 is set to be less than the minimum radial thickness of a portion of the bore inner pipe 31 around the annular connecting part 33 and the minimum radial thickness of a portion of the bore outer pipe 32 around the annular connecting part 33. Besides, the axial board thickness of the annular connecting part 33 is set to be less than the radial thickness, i.e. radial wall thickness of the annular connecting part 33. Furthermore, radial thickness of the bore outer pipe 32 is set to be greater than the radial thickness of the bore inner pipe 31. Thus, the radial thickness of the annular connecting part 33 of the bore wall part 6 becomes large, and the axial board thickness of the annular connecting part 33 becomes small. Therefore, rigidity and strength of the annular connecting part 33 largely decreases, so that the annular connecting part 33 can be flexibly deformed, and contraction of the bore outer pipe 32 occurred in its molding process does not have a large influence to the bore inner pipe 31. Therefore, the inner periphery 8 of the bore inner wall 31 can be restricted from being deformed.

The substantially annular recess 44 is formed around the first valve bearing 41 in the circumferential outer periphery of the bore outer pipe 32. The first valve bearing 41 is connected to the inner periphery 32*a* of the bore outer pipe 32 via the bore inner pipe 31 and the annular connecting part 33. The sidewall 7*a* of the sidewall part 36 of the motor housing part 7 connects to the sidewall 6*a* of the bore outer pipe 32 via plural plate-shaped connecting members 9. That is, the first valve bearing 41 is not directly connected to the outer wall (sidewall 6*a*) of the bore outer pipe 32, and the motor housing part 7 is not directly connected to the sidewall 6*a* of the bore outer pipe 32. Therefore, the bore outer pipe 32 is not apt to be largely affected by contraction of the motor housing part 7. Besides, the bore inner pipe 31 is not apt to be largely affected by contraction of the bore outer pipe 32. Thus, the inner periphery 8 of the bore inner wall 31 can be further restricted from deformation caused by contraction of the motor housing part 7 and bore outer pipe 32.

Figure 13:
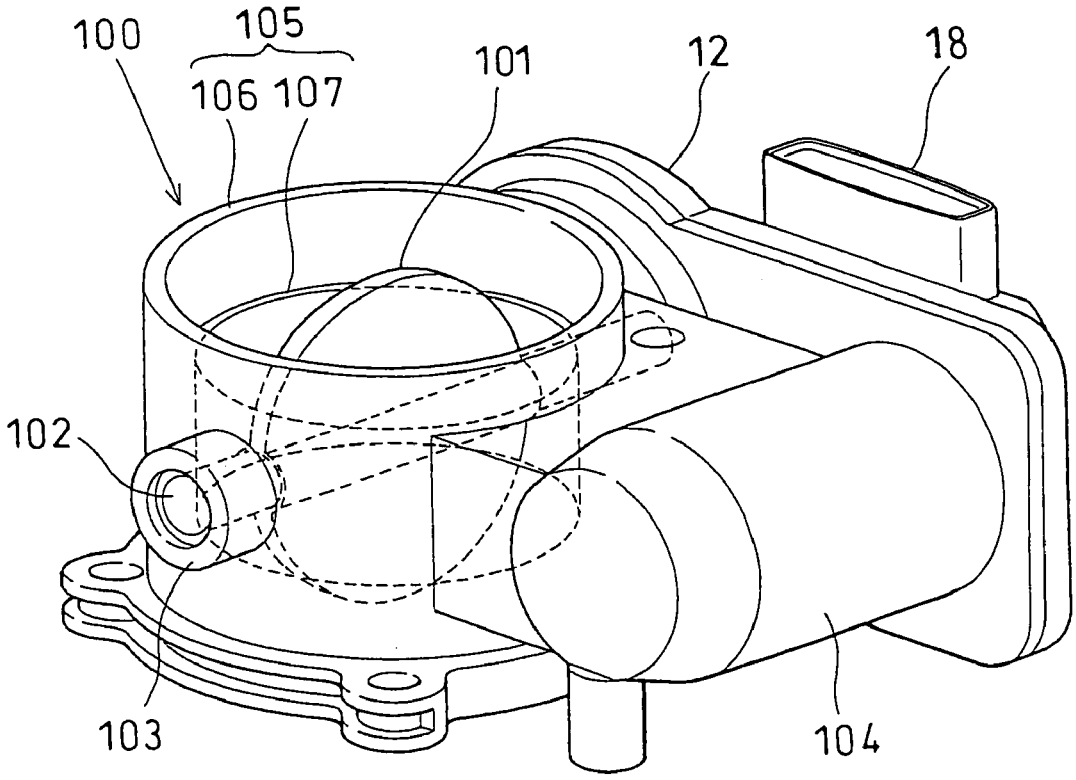
FIG. 13 RELATED ART
FIGS. 13 and 14 are perspective views showing an electrically controlled throttle apparatus according to a related art.
Figure 14:
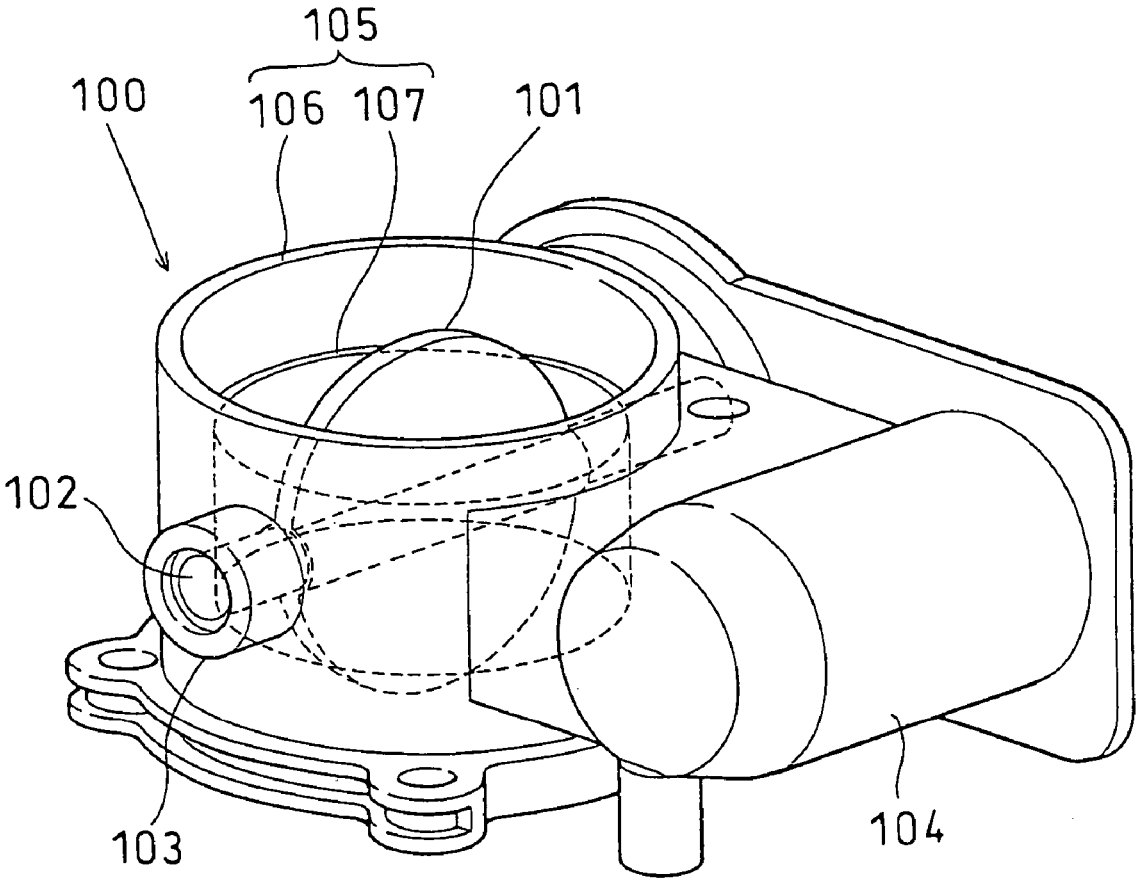
FIG. 14 RELATED ART
Figure 15:
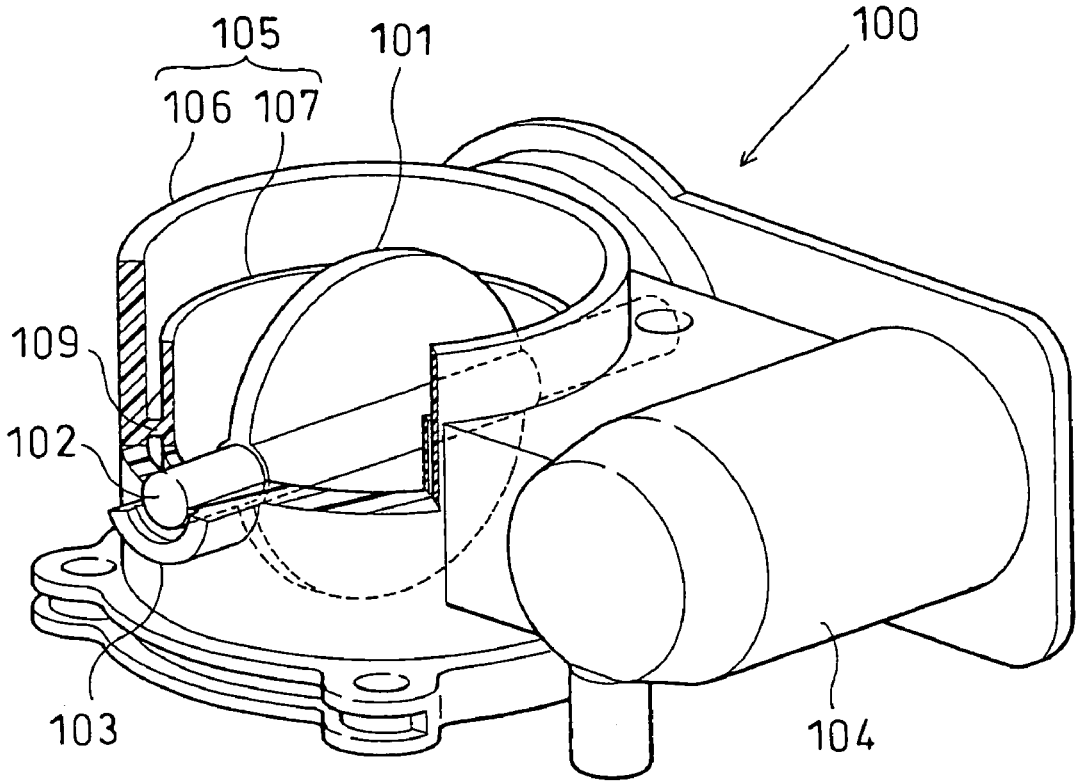
FIG. 15 RELATED ART
FIG. 15 is a perspective partially cross-sectional view showing the electrically controlled throttle apparatus according to the related art.

In the electrically controlled throttle apparatus of the present invention, circularity of the inner periphery 8 of the bore inner pipe 31 of the bore wall part 6 can be restricted from degradation due to contraction of a portion around the motor housing 7 and a portion around the bore outer pipe 32, compared with the conventional electrically controlled throttle apparatus shown in FIGS. 13 and 14. Therefore, circularity of the inner periphery (bore inner periphery) 8 of the bore inner pipe 31 of the bore wall part 6 can be maintained at a predetermined state. Thus, interference between the throttle valve 1 and the bore inner pipe 31 of the bore wall part 6 can be restricted over a rotation range (rotation angle range) of the throttle valve 1 from its full close position to its full open position.

Furthermore, a gap, which is formed between the cylindrical inner periphery 8 of the bore inner pipe 31 of the bore wall part 6 and the outer circumferential periphery of the throttle valve 1, can be set at a predetermined degree when the throttle valve 1 is in its full close position in the idling operation. Accordingly, airtightness can be maintained when the throttle valve 1 is in the full close position, and leakage of intake air in the idling operation can be decreased. The amount of fuel, for instance gasoline, consumed in the engine 80 is controlled in accordance with a flow amount of intake air. Accordingly, reduction of the leakage of intake air in the idling operation contributes to improvement of fuel efficiency of the vehicle.

Furthermore, the same resinous material such as a thermo plastic, e.g., PPS or PBT may be used for molding the bore wall part 6 having the double-pipe structure, the throttle body 5 including the motor housing part 7 and the resinous disc part 14 of the throttle valve 1. Therefore, the gap formed between the circular inner periphery 8 of the bore inner pipe 31 of the bore wall part 6 and the outer circumferential periphery of the resinous disc part 14 of the throttle valve 1 can be restricted from variation caused by a change of ambient temperature due to difference of a linear expansion coefficient of the respective resinous material.

Second Embodiment

Figure 4:
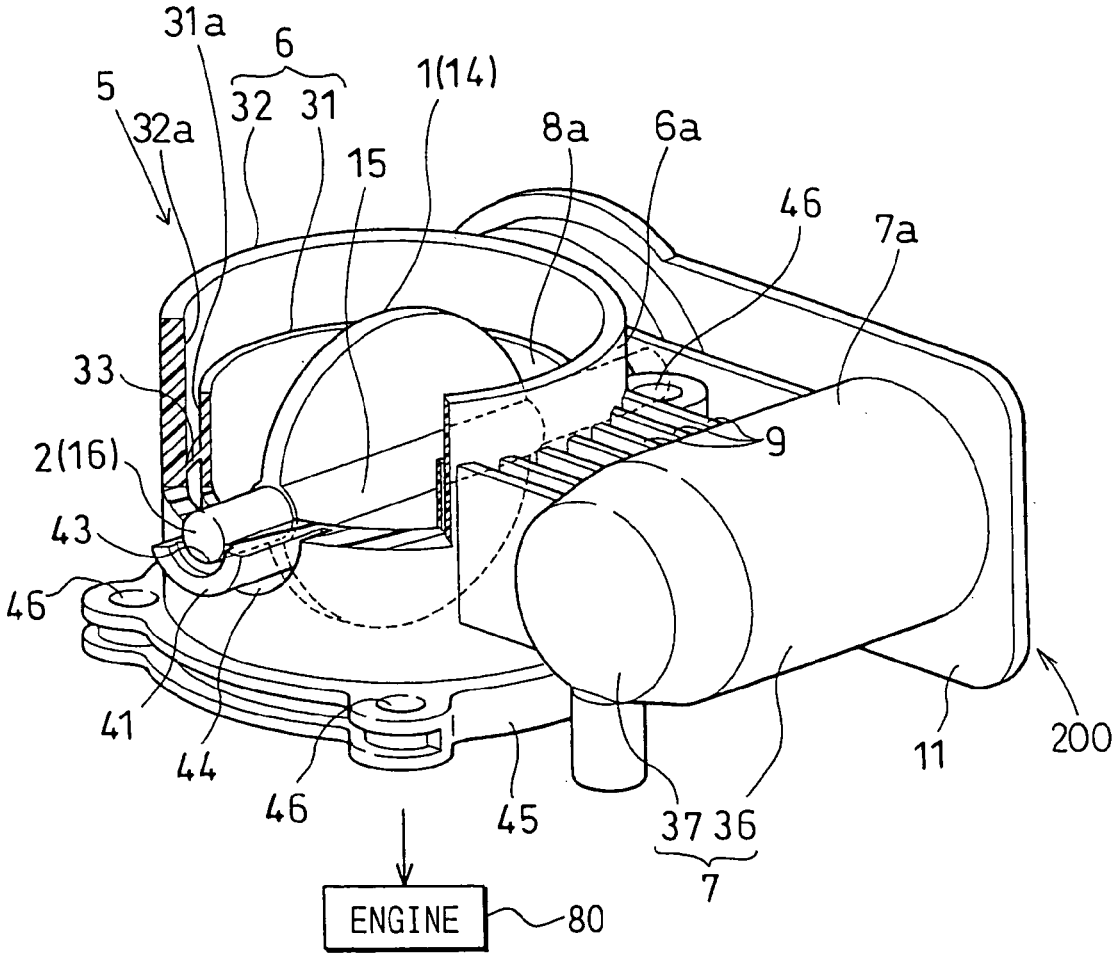
FIG. 4 is a perspective partially cross-sectional view showing an electrically controlled throttle apparatus according to a second embodiment of the present invention.

As shown in FIG. 4, an annular connecting part 33 is inclined with respect to the radial direction of the bore wall part 6 by a predetermined angle in the second embodiment. Specifically, the circumferentially end portion of the annular connecting part 33 is inclined in the downstream direction of intake air. Thus, rigidity and strength of the annular connecting part 33 can be decreased, and the annular connecting part 33 can be flexibly deformed. Thus, the inner periphery 8 of the bore inner pipe 31 can be restricted from deformation. Here, the circumferentially end portion may be inclined in the upstream direction of intake air.

The annular connecting part 33 connects the outer periphery 31*a* of the bore inner pipe 31 and the inner periphery 32*a* of the bore outer pipe 32, such that the annular connecting part 33 partitions substantially entirely over the circumferential area of the cylindrical space formed between the bore inner pipe 31 and the bore outer pipe 32. The annular connecting part 33 circumferentially blocks the cylindrical space at a substantially longitudinally central section thereof, i.e., a section along with a circumferential direction of the throttle valve 1 in its full close position.

Third Embodiment

Figure 5:
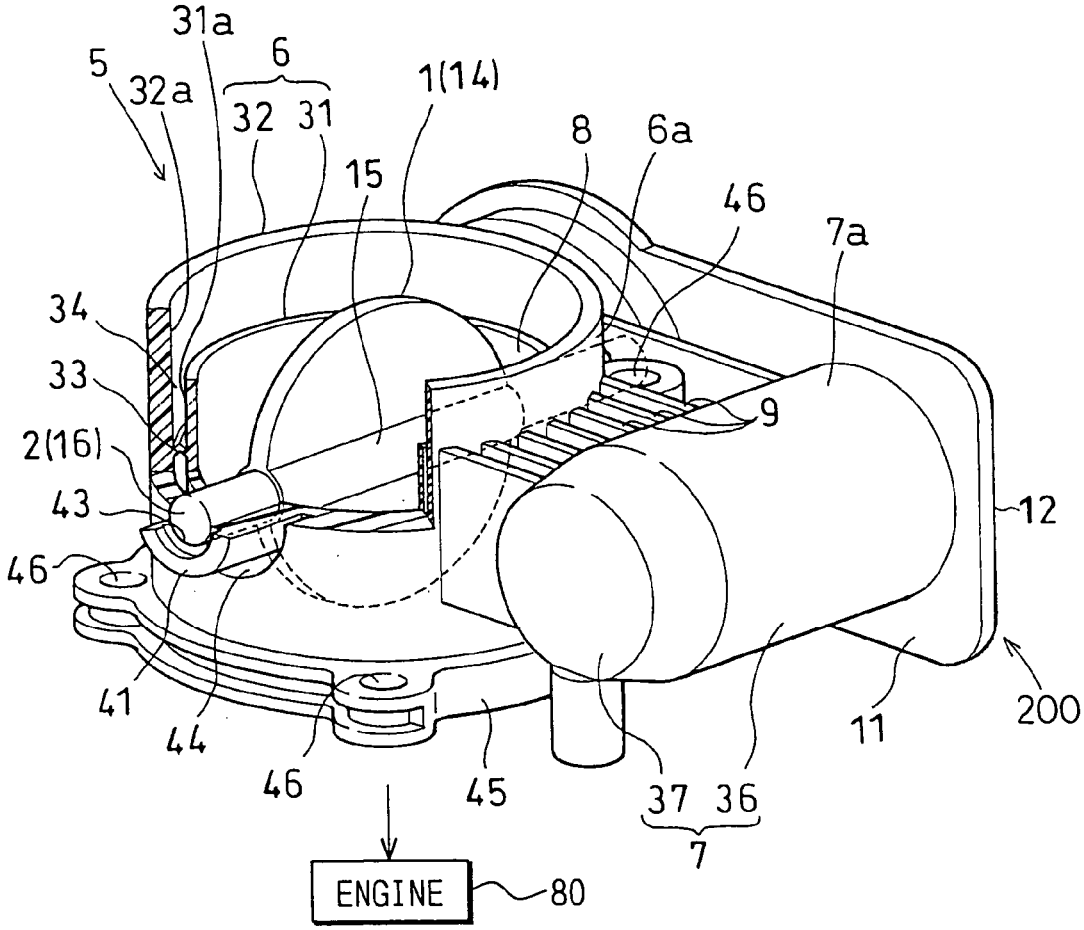
FIG. 5 is a perspective partially cross-sectional view showing an electrically controlled throttle apparatus according to a third embodiment of the present invention.

As shown in FIG. 5, a circumferential portion of an annular connecting part 33, for instance its substantially radially middle portion is circumferentially bent, so that the cross-section of the annular connecting part 33 in its radial direction becomes to be in an elbow-shape, i.e., angle-shape. Alternatively, the circumferential portion of the annular connecting part 33 can be bent, such that the cross-section of the annular connecting part 33 in its radial direction becomes to be in an arch-shape or S-shape. Thus, rigidity and strength of the annular connecting part 33 can be decreased, so that the inner periphery 8 of the bore inner pipe 31 can be restricted from deformation.

Fourth Embodiment

Figure 6:
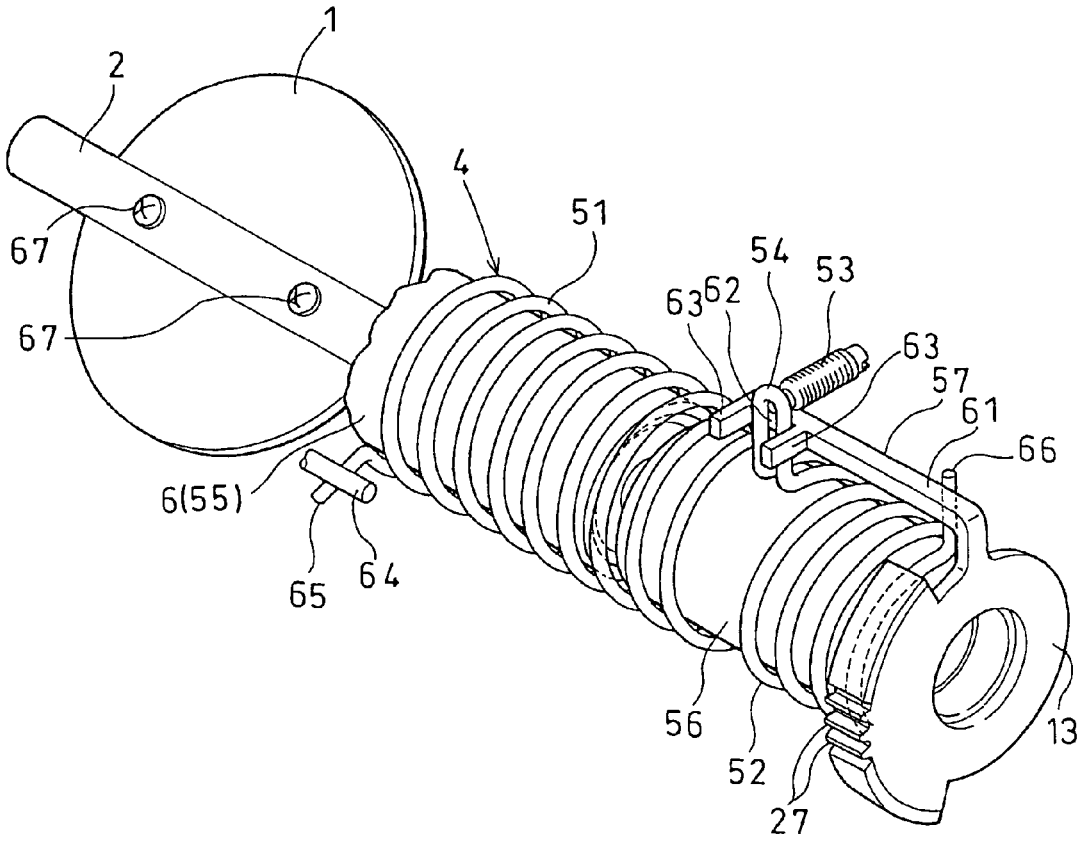
FIG. 6 is a perspective view showing an inner mechanism of the electrically controlled throttle apparatus according to a fourth embodiment of the present invention.

As shown in FIG. 6, the electrically controlled throttle apparatus in the fourth embodiment has a coil spring 4 constructed with a first spring part (return spring) 51 and a second spring part (default spring) 52. The return spring 51 serves as a returner spring and the default spring 52 serves as an opener spring. The return spring 51 and the default spring 52 are integrated into one coil spring (valve forcing means) 4 that urges a throttle valve 1 in the close direction and in the open direction of the throttle valve 1. The coil spring 4 is arranged between the outer wall 6*a* of the bore wall part 6, i.e., bottom wall of the gearbox part 11 and a plane of the valve gear 13 that is located on the side of the bore wall part 6. A connecting member between the return spring 51 and the default spring 52 is bent to be in a substantially U-shape to serve as a U-shaped hook part 54 supported by a middle stopper member 53. Both sides of the coil spring 4 are wound in different directions from each other. That is, the return spring 51 is wound in one direction, and the default spring 52 is wound in the opposite direction with respect to the winding direction of the return spring 51.

A boss-shaped middle position stopper (not shown) is provided in the gearbox part 11 of the throttle body 5, such that the middle position stopper internally protrudes in the gearbox part 11. A middle stopper member 53 (adjust screw) is screwed into the middle position stopper for mechanically maintaining the throttle valve 1 at a predetermined middle position using urging force of the return spring 51 and urging force of the default spring 52 when power supplied to the driving motor 3 is terminated. The urging force of the return spring 51 and the urging force of the default spring 52 are applied in different directions from each other. The predetermined middle position of the throttle valve 1 is a position between the full close position and the full open position. A cylindrical spring inner periphery guide 55 is integrally formed with the outer wall 6*a* of the bore wall part 6, i.e., bottom wall of the gearbox part 11 of the throttle body 5, to be protruded in the right direction in FIG. 6. The outer periphery of the spring inner periphery guide 55 supports the diametrically inner periphery of the coil spring 4. Another cylindrical spring inner periphery guide 56 is integrally formed with the plane of the valve gear 13 that is located on the side of the bore wall part 6. The cylindrical spring inner periphery guide 56 protrudes in the left direction in FIG. 6. The outer periphery of the spring inner periphery guide 56 supports the diametrically inner periphery of the coil spring 4.

An opener member 57 is integrally molded of a resinous material with the valve gear 13 in this embodiment. The opener member 57 is located on the side of the bore wall part 6 with respect to the valve gear 13, and is urged by the default spring 52 from the full close position toward the middle position in the open direction. A gear-side hook (second hooking part) 61, a hooking part 62 and slip restricting guides 63 are integrally formed with the opener member 57.

The gear-side hook 61 hooks to one end of the default spring 52 of the coil spring 4 in the right end in FIG. 6. The hooking part 62 detachably hooks to the U-shaped hook part 54 connecting the return spring 51 and the default spring 52. The slip restricting guides 63 are arranged near the hooking part 62 for restricting movement of the U-shaped hook part 54 in the axial direction of the coil spring 4.

A spring body-side hook (first hooked part) 65 is provided on one end side of the return spring 51 of the coil spring 4, which is located on the side of the bore wall part 6 on the left side in FIG. 6. The spring body-side hook 65 hooks to a body-side hook 64 (first hooking part) that is integrally formed with the outer wall 6*a* of the bore wall part 6, i.e., bottom wall of the gearbox part 11 of the throttle body 5. A spring gear-side hook (second hooked part) 66 is provided on the side of the default spring 52 of the coil spring 4, which is located on the side of the valve gear 13, i.e., on the right side in FIG. 6. The spring gear-side hook 66 hooks to the gear-side hook (second hooking part) 61 of the opener member 57.

In the fourth embodiment, the throttle valve 1 is formed of a metallic material or a resinous material to be in a substantially disc-shape. The throttle valve 1 is inserted into a valve insertion hole (not shown) formed in a valve supporting portion of a throttle shaft 2, and screwed onto the throttle shaft 2 using a fastening member 67, such as a screw. The throttle shaft 2 is formed of a metallic material or the like to be in a round-bar shape, for example. Both of the end sides of the throttle shaft 2 is rotatably supported by the first valve bearing 41 and the second valve bearing of the bore wall part 6 of the throttle body 5 to be slidable each other. Therefore, the throttle valve 1 and the throttle shaft 2 can be integrally rotated.

As follows, an operation of the electrically controlled throttle apparatus, when power supplied to the driving motor 3 is terminated, is described. The hooking part 62 of the opener member 57 contacts the U-shaped hook part 54 of the coil spring 4, while the opener member 57 is inserted between the connecting end part of the default spring 52, i.e., the U-shaped hook part 54, and the spring gear-side hook 66. In this situation, the hooking part 62 and the U-shaped hook part 54 are urged onto each other by urging force of the return spring 51 and urging force of the default spring 52 used as the opener spring. Here, the return spring 51 returns the throttle valve 1 from its full open position to its full close position via the opener member 57. The default spring 52 returns the throttle valve 1 from its full close position to its middle position via the opener member 57. Thus, the throttle valve 1 can be maintained at the middle position, so that a fall back operation, i.e., failsafe operation can be performed when power supplied to the driving motor 3 is terminated.

Fifth Embodiment

As described above, the annular connecting part 33 is formed to be in a thin-walled plate shape that is thinner than the wall thickness of the bore inner pipe 31 and the wall thickness of the bore outer pipe 32. The radial cross-sectional length of the annular connecting part 33 is elongated to be larger than the axial board thickness of the annular connecting part 33, so that rigidity and strength of the annular connecting part 33 decreases in the internally connected double pipe structure of the bore wall part 6.

However, in the above internally connected structure, flow resistance of filler (molten resinous material) may increase in a cavity formed in molding dies for molding the annular connecting part 33. As a result, flow and filling of the filler in the cavity of the molding dies may become insufficient.

Figure 9:
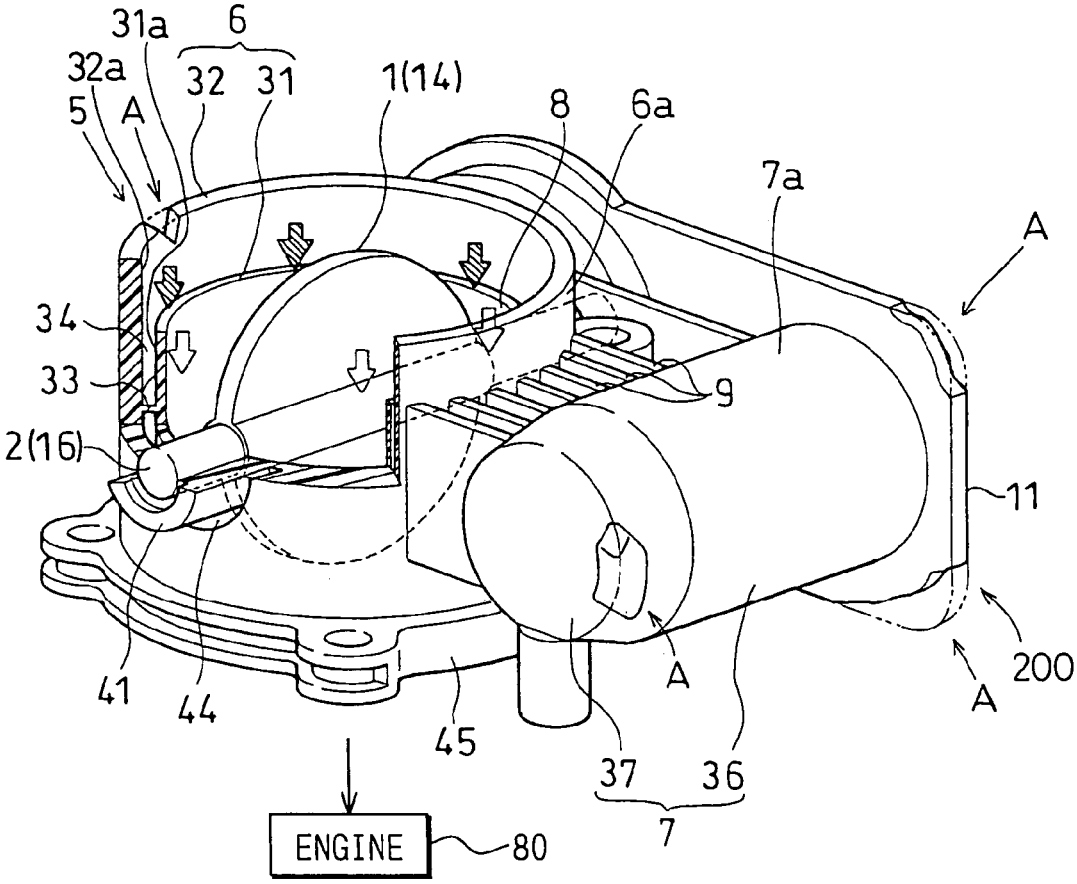
FIG. 9 is a perspective partially cross-sectional view showing an electrically controlled throttle apparatus including a molded throttle body according to a first example.

In the first example as shown in FIG. 9, gates shown by arrows are formed in the cavity of the molding dies on the side of the bore inner pipe 31 for injecting filler (molten resinous material). In this case, flow resistance of the filler increases in a portion of the cavity forming the annular connecting part 33 while the filler flows in the cavity of the molding dies. As a result, the filler does not flow over the cavity of the molding dies, and the filler may be insufficiently filled in the cavity of the molding dies. Accordingly, a short cut (short shot, short mold) A may arise in the bore outer pipe 32, in the motor housing part 7 and/or the gearbox part 11.

Figure 10:
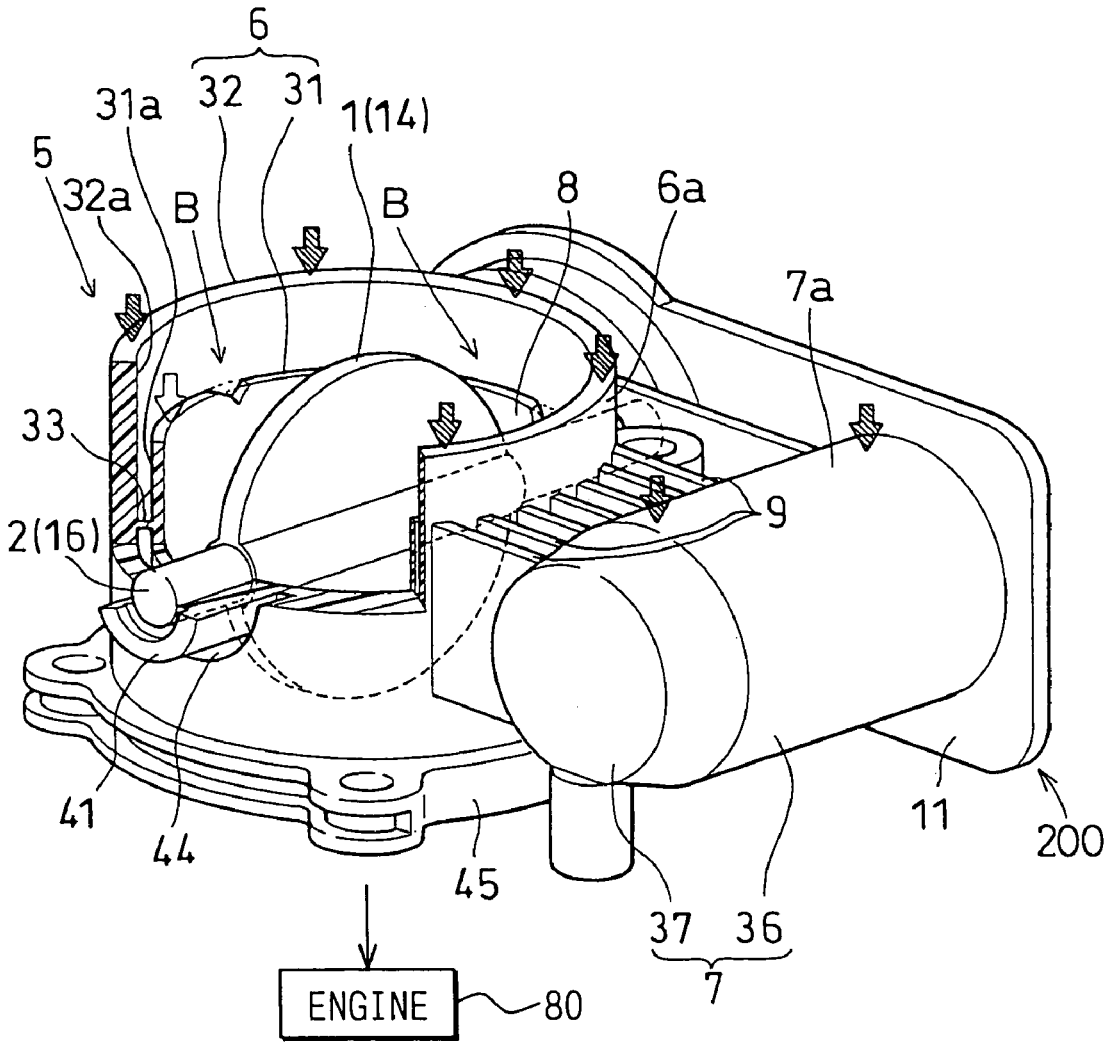
FIG. 10 is a perspective partially cross-sectional view showing an electrically controlled throttle apparatus including a molded throttle body according to a second example.

In the second example as shown in FIG. 10, gates shown by arrows are formed in the cavity of the molding dies on the side of the bore outer pipe 32. In this case, flow resistance of the filler also increases in a portion of the cavity forming the annular connecting part 33, and a short cut B may arise in the bore inner pipe 31.

Figure 11:
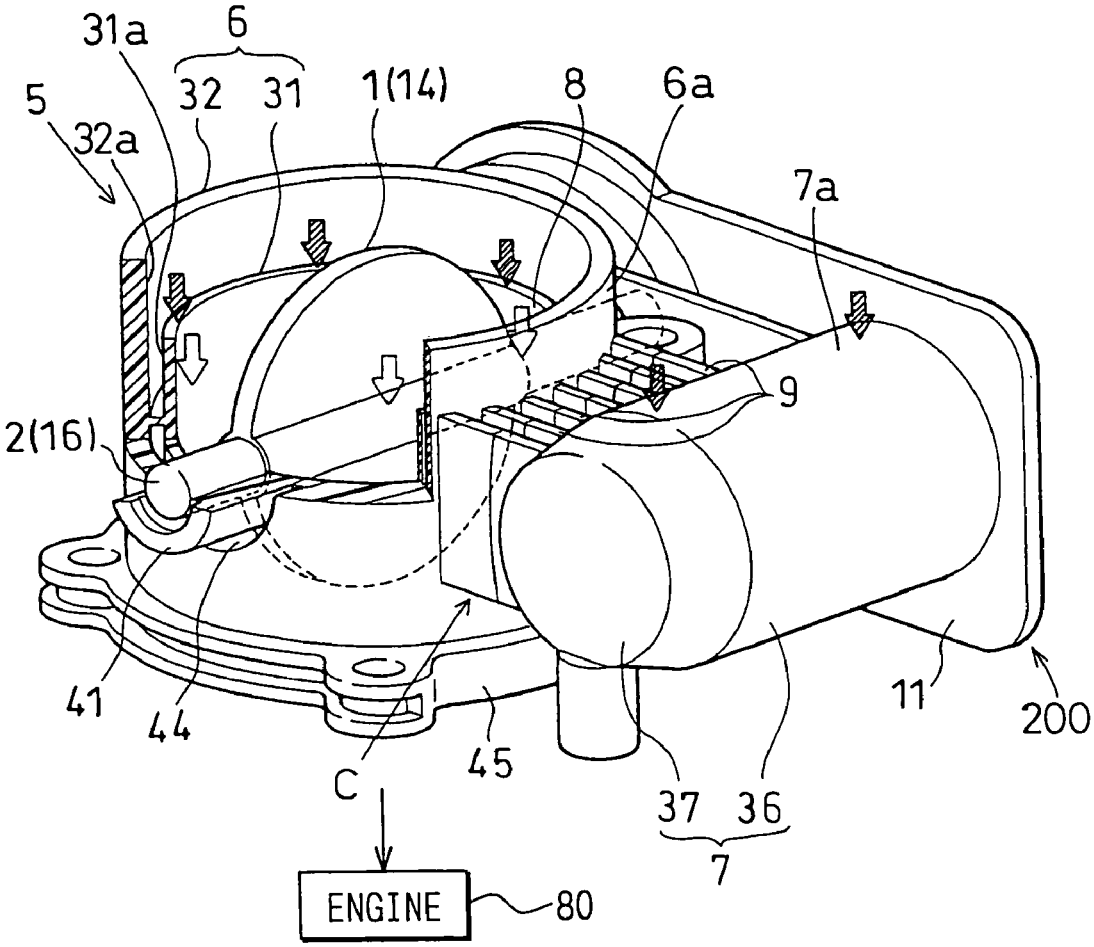
FIG. 11 is a perspective partially cross-sectional view showing an electrically controlled throttle apparatus including a molded throttle body according to a third example.

In the third example as shown in FIG. 11, gates shown by arrows are formed in the cavity of the molding dies on the sides of the bore inner pipe 31, the bore outer pipe 32 and/or the motor housing part 7. In this case, flow resistance of the filler also increases in a portion of the cavity forming the annular connecting part 33. Additionally, the filler flows from both sides of the bore outer pipe 32 and the motor housing part 7, and the filler flowing from both sides may adhere with each other in a portion of the cavity, in which the plural plate-shaped connecting members 9 are molded. Therefore, a weld (weld line) C may arise in the plural plate-shaped connecting members 9 connecting the sidewall 7*a* of the sidewall part 36 of the motor housing part 7 and the sidewall 6*a* of the bore outer pipe 32. The motor housing part 7 receives a heavy component such as the driving motor 3. Accordingly, the plural plate-shaped connecting members 9 needs to be strong enough to support heavy components such as the motor housing part 7 and the bore wall part 6 receiving the throttle valve 1. However, strength of the plural plate-shaped connecting members 9 may decrease due to forming of the weld C.

Figure 8A:
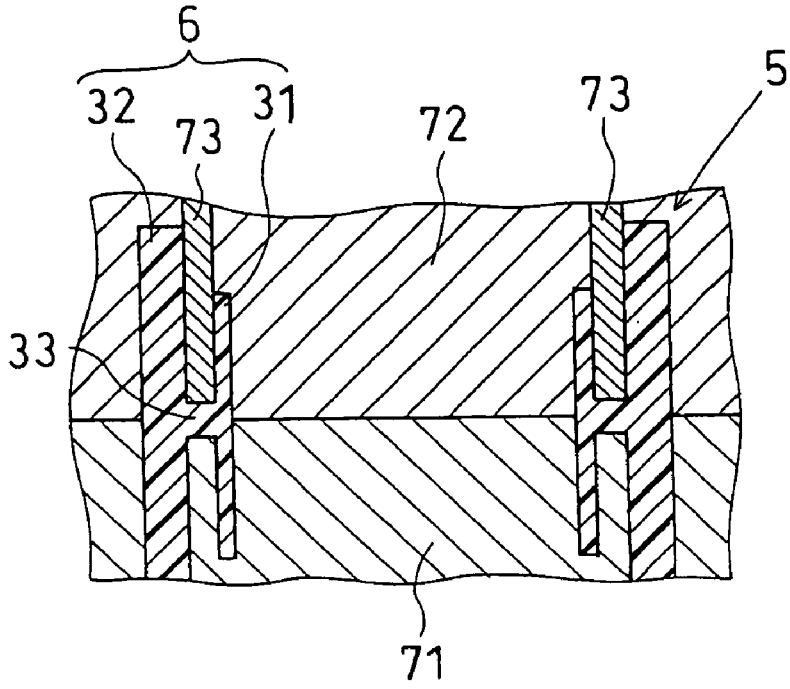
FIGS. 8A and 8B are schematic cross-sectional side views showing an injection press molding process of the throttle body according to the fifth embodiment.
Figure 8B:
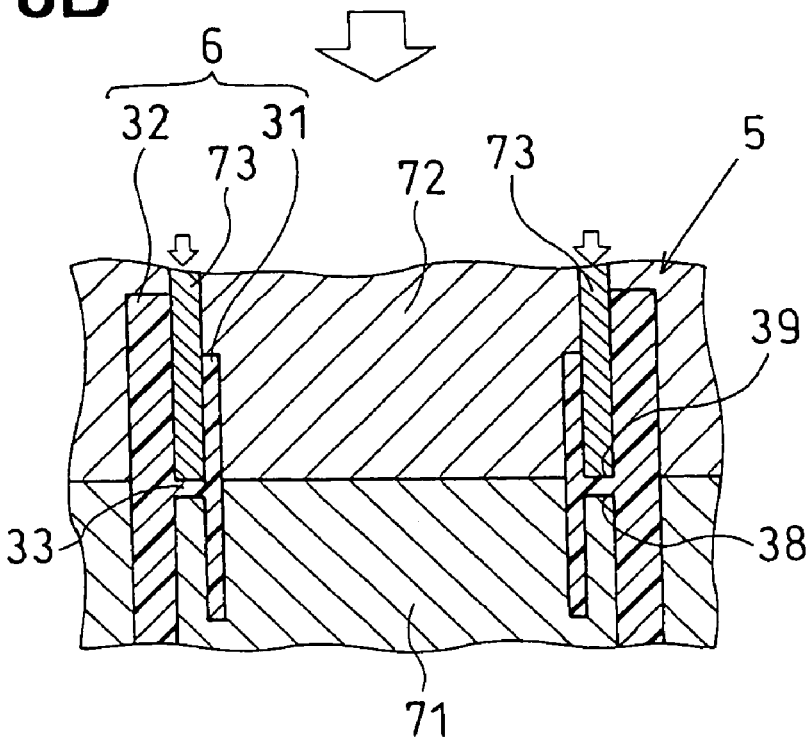

As shown in FIGS. 8A and 8B in the fifth embodiment, a molding process of the throttle body 5 includes a first clamping process and a second clamping process. In the first clamping process, molding dies are clamped with each other to form a first cavity that has an internal volume greater than a volume of the molded throttle body 5. Specifically, the first cavity has a portion for molding the annular connecting part 33 having an internal volume that is greater than at least a volume of the molded annular connecting part 33. In the second clamping process, the molding dies are clamped with each other to form a second cavity that has an internal volume substantially the same as the volume of the molded throttle body 5. Specifically, the first cavity has a portion for molding the annular connecting part 33 having an internal volume that is substantially the same as a volume of the molded annular connecting part 33, at least. The molding dies can be used in both the first clamping process and the second clamping process. The molding dies include a fixed die 71 and a movable die 72 that have a protrusion and a recession corresponding to the bore inner pipe 31, the bore outer pipe 32, the annular connecting part 33 and the like for molding the throttle body 5. A substantially cylindrical shaped compression core (movable core, slide core, movable die) 73 is received in the movable die 72 to be displaceable with respect to the movable die 72. The shape of the compression core 73 corresponds to the cylindrical space of the air intake passage formed in the bore wall part 6 on the upstream side of the intake airflow. The compression core 73 is displaced with respect to the fixed die 71 by a compression-core driving apparatus (not shown) constructed with a hydraulic cylinder, an air cylinder or the like.

When the compression core 73 is in an initial position, i.e., before compression as shown in FIG. 8A, the first cavity is formed among the fixed die 71, the movable die 72 and the compression core 73. The first cavity has an internal volume greater than at least a total volume of the bore inner pipe 31, bore outer pipe 32 and the annular connecting part 33. When the compression core 73 is displaced to be in a forward position, i.e., after compression as shown in FIG. 8B, the second cavity is formed among the fixed die 71, the movable die 72 and the compression core 73. The second cavity has an internal volume substantially the same as a total volume of the bore inner pipe 31, bore outer pipe 32 and the annular connecting part 33. As shown by a stippled section in FIG. 7, an annular end face 39 of the molten resinous material filled in the portion of the cavity for molding the annular connecting part 33 is compressed by a predetermined compression force. The annular end face 39 is an annular end face of the annular connecting part 33 in its axial direction.

Figure 7:
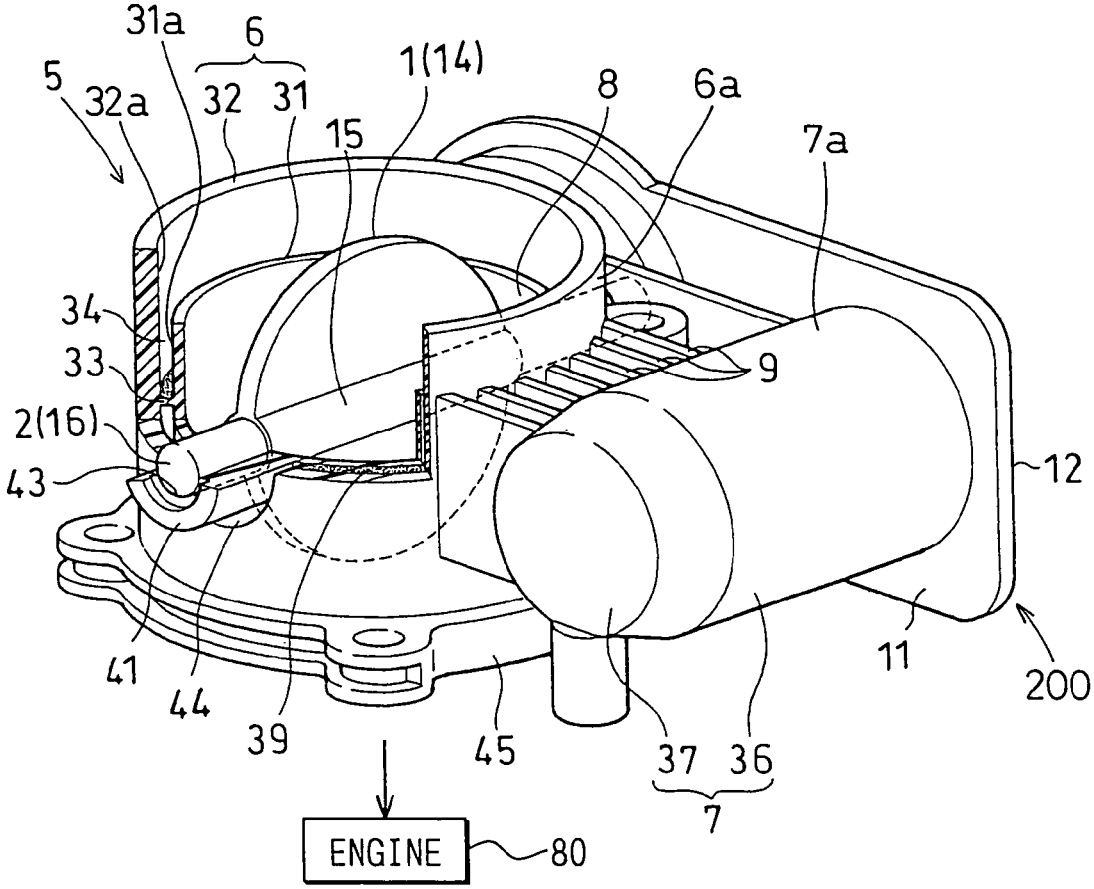
FIG. 7 is a perspective partially cross-sectional view showing an electrically controlled throttle apparatus according to a fifth embodiment of the present invention.

As follows, injection press molding process is described. Referring to FIGS. 7, 8A and 8B, heated thermo plastic (filler), i.e., thermo stable plastic such as PPS or PBT in a molten state is injected into the first cavity formed in the molding dies constructed with the fixed die 71, the movable die 72 and the compression core 73. The filler is injected into the first cavity through at least one gate formed in the molding dies, so that the first cavity formed in the molding dies is filled with the filler (molten resinous material), in an injection-filling process.

Subsequently, pressure applied to the filler in the molding dies is gradually increased, and the increased pressure is maintained at a pressure greater than the maximum pressure applied to the injected filler in the injection-filling process. That is, predetermined pressure greater than injection pressure is applied to the filler (molten resinous material) filled in the molding dies. Subsequently, cooling water is introduced into the molding dies. In this situation, the filler contracts (shrinks) in the molding dies due to the cooling process. Therefore, additional filler is injected into the first cavity through at least one gate formed in the molding dies to refill additional filler by an amount equivalent to a reduced volume of the molded filler due to the contraction caused in the cooling process, in a pressure holding process. The gate can be formed in the molding dies on at least one of the side of the bore inner pipe 31, the side of the bore outer pipe 32 and/or the side of the motor housing part 7.

As shown in FIG. 8A, the compression core 73 is fixed in the initial position before the compression, and the molding dies are clamped with each other, in the first clamping process during the injection-filling process and/or the pressure holding process. In this situation, the axial board thickness of the annular connecting part 33 is set to be equal to or greater than the minimum radial wall thickness of the bore inner pipe 31 and the minimum radial wall thickness of the bore outer pipe 32 that are located around the annular connecting part 33. Therefore, the axial board thickness of the annular connecting part 33 is set to be large in the first cavity during the injection-filling process and/or the pressure holding process, so that flow resistance of the filler (molten resinous material) decreases while the filler flows through the first cavity. Thus, even when a gate is formed in the molding dies on one of the sides of the bore inner pipe 31, the bore outer pipe 32 and the motor housing part 7, the bore inner pipe 31, the bore outer pipe 32 and the motor housing part 7 can be restricted from occurrence of short cut of filler.

Besides, the compression core 73 compresses filler filled in the first cavity formed in the molding dies. Therefore, filler filled in a portion of the cavity forming the bore wall part 6 is extruded from a cavity forming the sidewall 6*a* of the bore outer pipe 32 into a cavity forming the motor housing part 7 via a cavity forming the plural plate-shaped connecting members 9. Therefore, weld C, which is apt to be formed in the plural plate-shaped connecting members 9, can be displaced to the side of the motor housing part 7, so that the plural plate-shaped connecting members 9 can be restricted from internal formation of weld C. Therefore, a portion (e.g., plate-shaped connecting member 9), which supports both of the motor housing pert 7 receiving the heavy driving motor 3 and the bore outer pipe 32, can be restricted from internal formation of weld C. Thus, strength of the throttle body 5 can be maintained.

Filler (molten resinous material) is filled into the first cavity by an amount equal to or greater than a predetermined volume, e.g., by 80% of the volume of the first cavity. As shown in FIG. 8B, at least one gate is closed (gate cut) and the compression core 73 is slid to a forward position (after compression) in a direction, in which the compression core 73 approaches the fixed die 71 to form the second cavity among the fixed die 71, movable die 72 and the compression core 73 in a compression process during the injection-filling process and/or the pressure holding process. Thus, the annular end face 39 of the annular connecting part 33 is compressed by the compression core 73 in the second cavity. The predetermined volume of the filler filled into the first cavity is less than the internal volume of the first cavity.

An annular end face 38 of the annular connecting part 33 located on the lower end side in FIG. 8B may be compressed using another compression core (not shown), simultaneously with compressing the annular end face 39, i.e., compressed portion using the compression core 73. Here, the annular end face 38 is located on the downstream side of intake airflow, and located on the opposite side of the annular end face 39 with respect to the annular connecting part 33. The annular end face 39 is located on the upper end in FIG. 8B, i.e., on the upstream side of intake airflow.

In this situation, the molding dies are clamped with each other and the compression core 73 is slid to the forward position, so that the axial board thickness of the annular connecting part 33 becomes less than the minimum radial thickness of the bore inner pipe 31 and the minimum radial thickness of the bore outer pipe 32 in the second clamping process of the fifth embodiment. Preferably, the molding dies are clamped with each other, so that the axial board thickness of the annular connecting part 33 becomes less than the radial wall thickness of the annular connecting part 33 in the second clamping process. Subsequently, the filler filled in the second cavity of the molding die is taken out, and is cooled to be solidified. Alternatively, the filler filled in the second cavity of the molding die is cooled to be solidified using cooling water or the like, while the filler is received in the second cavity. Thus, the throttle body 5 including the bore wall part 6 having a double pipe structure can be integrally molded of the filler, similarly to the first embodiment.

As a result, the annular connecting part 33, which connects the bore inner pipe 31 and the bore outer pipe 32, and each of the plural plate-shaped connecting members 9, which connects the motor housing part 7 and the bore outer pipe 32, can be formed to be in a thin-walled elongated plate shape. Besides, the recess 44 can be formed around the first valve bearing 41, and the first valve bearing 41 can be formed to connect to the inner periphery 32*a* of the bore outer pipe 32 via the bore inner pipe 31 and the annular connecting part 33. Thus, the inner periphery 8 of the bore inner wall 31 can be restricted from deformation caused by contraction of the motor housing part 7 and bore outer pipe 32, so that airtightness can be maintained when the throttle valve 1 is in the full close position. Aditionally, the gearbox part 11, bore outer pipe 32 and the motor housing part 7 can be restricted from occurrence of shortcut A thereof, and the bore inner pipe 31 can be restricted from occurrence of shortcut B thereof. Furthermore, a supporting portion (e.g., connecting members 9) can be also restricted from formation of weld C thereof, using the above injection press molding process.

Sixth Embodiment

Figure 12:
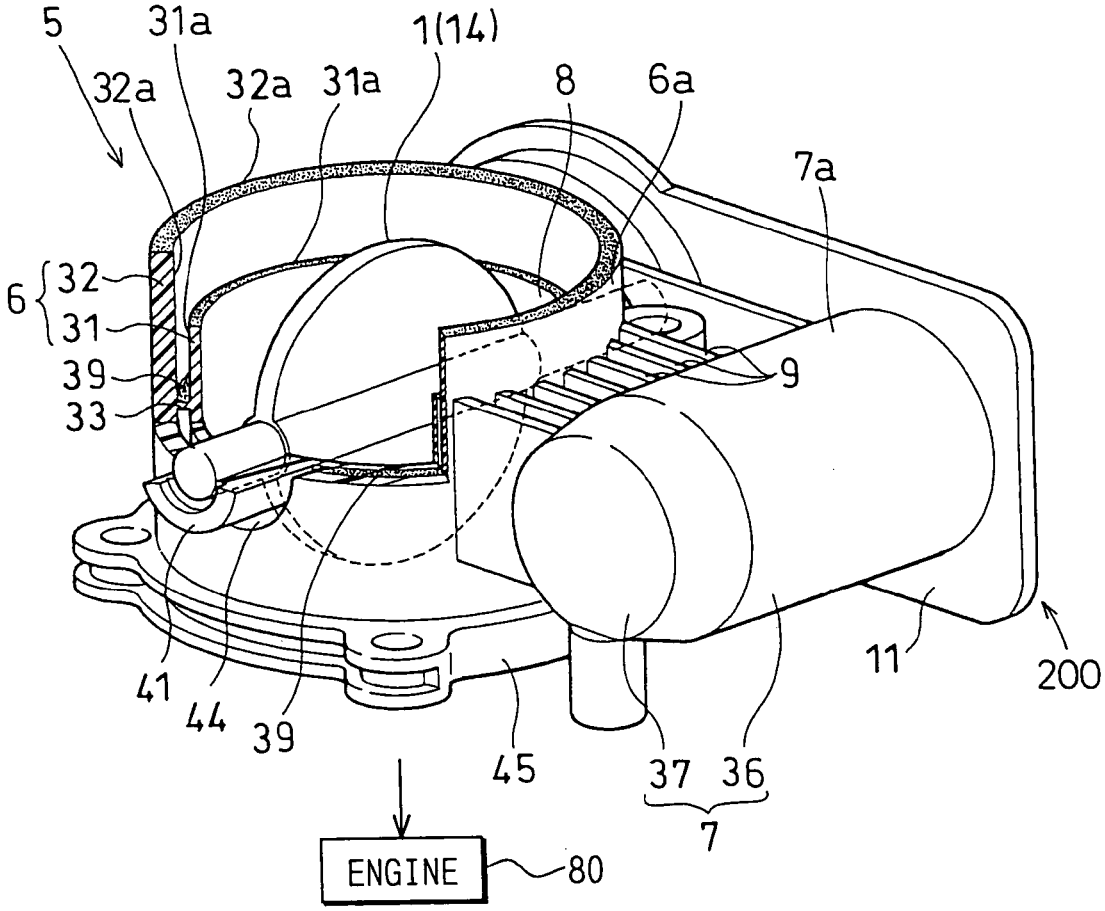
FIG. 12 is a perspective partially cross-sectional view showing the electrically controlled throttle apparatus molded using an injection press molding process according to a sixth embodiment of the present invention.

In the sixth embodiment as shown in FIG. 12, an annular end face 31*a* of the bore inner pipe 31 and/or an annular end face 32*a* of the bore outer pipe 32 of the bore wall part 6 are compressed using a compression core 73, simultaneously with compressing the annular end face 39 of the annular connecting part 33.

Each of the annular end face 31*a* of the bore inner pipe 31, the annular end face 32*a* of the bore outer pipe 32 and the annular end face 39 of the annular connecting part 33 described in the fifth embodiment are compressed portions shown by stippled sections located on the upper end face in FIG. 12, i.e., on the upstream side of intake airflow. Besides, the annular end face (not shown) on the axially opposite side as the annular end face 32*a* with respect to the bore outer pipe 32 can be compressed using another compression core (not shown), simultaneously with the compression of at least one of the annular end faces 31*a*, 32*a* and 39. The annular end face (not shown) on the axially opposite side as the annular end face 31*a* with respect to the bore inner pipe 31 can also be compressed using another compression core (not shown), simultaneously with the compression of at least one of the annular end faces 31*a*, 32*a* and 39. The annular end face on the axially opposite side as the annular end face 32*a* with respect to the bore outer pipe 32 and the annular end face on the axially opposite side as the annular end face 31*a* with respect to the bore outer pipe 31 can also be simultaneously compressed.

In an injection process of the throttle body 5, a contraction rate of the filler (molten resinous material) may disperse in the bore inner pipe 31 due to orientation of fiber and molecular orientation caused by flow of the filler. However, as described in the fifth and the sixth embodiments, the compression process is added to the injection molding process of the throttle body 5. Thus, difference of a contraction rate of the filler, which forms the bore inner pipe 31, can be relaxed, and dispersion of contraction of the filler can be decreased. Therefore, circularity of the bore inner periphery of the bore inner pipe 31 can be maintained.

Specifically, compression stress is applied to at least one of the bore inner pipe 31, bore outer pipe 32 and the annular circular part 33 in the axial direction thereof. Therefore, internal stress radially working in the bore inner pipe 31, bore outer pipe 32 and the annular circular part 33 can be uniformed, so that the inner bore pipe 31 can be restricted from deformation in its radial direction.

Other Embodiment

A hall IC or a magnetoresistive element or the like can be used as a noncontact sensor, instead of the hall element. A cylindrical-shaped permanent magnet can be used as a magnetic field source, instead of the separated permanent magnets 10. A substantially disc-shaped resinous disc part (disc-shaped part) 14 and a substantially cylindrical shaped resinous shaft part (cylindrical-shaped part) 15 can construct a throttle valve (resinous valve) 1, and only a substantially cylindrical shaped metallic member can construct a throttle shaft (metallic shaft) 2.

The outer periphery of the valve supporting portion of the throttle shaft 2 can be knurled partially or entirely. That is, a rough surface can be formed on the outer periphery of the valve supporting portion, so that a sticking characteristic (connecting performance) can be enhanced between the inner periphery of the resinous shaft part 15 of the throttle valve 1 and the outer periphery of the valve supporting portion of the throttle shaft 2. Namely, a serration, notches, grooves or the like are partially or entirely formed on the outer periphery of the valve supporting portion, so that relative displacement are restricted between the throttle valve 1 and the throttle shaft 2 in the axial direction thereof. Thus, the throttle valve 1 can be prevented from being pulled out of the valve supporting portion of the throttle shaft 2. Alternatively, the cross-section of the valve supporting portion of the throttle shaft 2 can be formed in a substantially circular shape having a bolt width. In this structure, the valve supporting portion of the throttle shaft 2 has substantially parallel flat faces along with its axial direction. Alternatively, the cross-section of the resinous shaft part 15 of the throttle valve 1 can be formed in a substantially cylindrical shape having a bolt width. In this structure, resinous shaft part 15 has substantially parallel flat faces along with its axial direction. In this case, relative displacement can be restricted between the throttle valve 1 and the throttle shaft 2 in the rotation direction thereof. A resinous shaft can be used as the throttle shaft 2. In this case, the resinous shaft can be integrally molded of a resinous material with the resinous shaft part 15 of the throttle valve 1, so that the number of components of the throttle valve 1 can be reduced.

The above throttle body 5 may be applied to a throttle apparatus, which does not have a driving motor 3, used for an internal combustion engine. In this case, a lever part, which is mechanically connected to an accelerator pedal via a wire cable, is provided instead of the valve gear 13 that is provided on the end of the metallic shaft part 16 of the throttle shaft 2. In this structure, the accelerator position operated by a driver can also be transmitted to the throttle valve 1 and the throttle valve 2.

A compression core can be provided inside of the fixed die 71 to be displaceable, such that the compression core can approach the movable die 72, and the compression core can depart from the movable die 72. Alternatively, compression cores can be respectively provided inside of both the fixed die 71 and the movable die 72. In this case, the compression core provided inside of the fixed die 71 is displaceable, such that the compression core can approach the movable die 72 and the compression core can depart from the movable die 72. Besides, the compression core provided inside of the movable die 72 is displaceable, such that the compression core can approach the fixed die 71 and the compression core can depart from the fixed die 71.

The central axis of the bore inner pipe 31 can be eccentrically arranged with respect to the central axis of the bore outer pipe 32 to construct the bore wall part 6 having an eccentric double-pipe structure. That is, the axial center of the bore inner pipe 31 can be eccentrically arranged on an internally one side of the bore outer pipe 32 in the radial direction of the bore outer pipe 32, e.g., vertically lower side of the bore outer pipe 32 in its installation condition. Here, the radial direction of the bore wall part 6 is perpendicular to the axial direction of the bore wall part 6. Alternatively, the axial center of the bore inner pipe 31 can be eccentrically arranged on internally another side of the bore outer pipe 32 in the radial direction of the bore outer pipe 32, e.g., vertically upper side of the bore outer pipe 32 in its installation condition. Alternatively, the bore wall part 6 of the throttle body 5 may has a single pipe structure.

Radial thickness of the bore outer pipe 32 may be equal to or less than radial thickness of the bore inner pipe 31. However, the axial board thickness of the annular connecting part 33 is set to be less than the minimum radial thickness of a portion of the bore inner pipe 31 around the annular connecting part 33 and the minimum radial thickness of a portion of the bore outer pipe 32 around the annular connecting part 33.

The blockade recess parts 34, 35 are formed between the bore inner pipe 31 and the bore outer pipe 32 for blocking moisture or liquid flowing into the bore wall part 6 from both of the upstream and the downstream sides of the throttle valve 1. The blockade recess parts 34, 35 are used to restrict the throttle valve 1 from icing in a cold period such as winter, without additional components, such as an additional piping member for introducing engine-cooling water into the throttle body 5. Alternatively, only the blockade recess part 34 can be provided in the bore wall part 6 for blocking moisture or liquid flowing from the upper side of the throttle valve 1 into the bore wall part 6 along with the inner periphery of the intake pipe. Thus, the number of the parts of the throttle apparatus can be decreased, so that the throttle apparatus can be downsized, and can be produced at a low cost.

A bypass passage can be provided on the outer peripheral side of the bore outer pipe 32 for bypassing the throttle valve 1. Furthermore, an idling speed control valve (ISC valve) can be provided in the bypass passage for controlling idling speed of the engine 80 by adjusting a flow amount of air passing through the bypass passage. An outlet port of blowby gas discharged from a positive crankcase ventilator (PCV) or a purge tube connected to a vapor recovery equipment for recovering vaporized gasoline may be connected to the intake pipe located on the upstream side of intake airflow with respect to the bore wall part 6 of the throttle body 5. In this case, engine oil contained in blowby gas may accumulate to be deposit on the inner wall of the intake pipe. However, in this structure, foreign material such as mist or deposit of blowby gas flowing along with the inner wall of the intake pipe can be blocked by the blockade recess part 34, so that the throttle valve 1 and the throttle shaft 2 can be restricted from occurrence of a failure.

The throttle body 5 can be integrally formed by resin molding or metal casting. The filler, which is formed to be the throttle body 5, can be a metallic material such as aluminum alloy or magnesium alloy.

Various modifications and alternations may be made to the above embodiments without departing from the spirit of the present invention.

What is claimed is:

1. A throttle body receiving a throttle valve, the throttle body comprising:

a bore wall part that has a double-pipe structure including:

an inner pipe that rotatably receives the throttle valve;

an outer pipe that is arranged on a radially outer side of the inner pipe to define a cylindrical space with an outer periphery of the inner pipe therebetween; and an annular connecting part that connects the inner pipe and the outer pipe, such that the annular connecting part partitions substantially entirely over a circumferential area of the cylindrical space defined between the inner pipe and the outer pipe, wherein the inner pipe, the outer pipe and the annular connecting part are integrally formed, the annular connecting part has an axial thickness that is less than a minimum thickness of the inner pipe in a radial direction thereof and a minimum thickness of the outer pipe in a radial direction thereof, the outer pipe has a radial thickness that is greater than a radial thickness of the inner pipe, and a first portion of the outer pipe, which is on an axially unstream side with respect to the annular connecting part, has a radial thickness that is substantially the same as a radial thickness of a second portion of the outer pipe, which is on an axially downstream side with respect to the annular connecting part.

2. A throttle body receiving a throttle valve, the throttle body comprising:

a bore wall part that has a double-pipe structure including:

an inner pipe that rotatably receives the throttle valve;

an outer pipe that is arranged on a radially outer side of the inner pipe to define a cylindrical space with an outer periphery of the inner pipe; and an annular connecting part that connects the inner pipe and the outer pipe, such that the annular connecting part partitions substantially entirely over a circumferential area of the cylindrical space defined between the inner pipe and the outer pipe, wherein the inner pipe, the outer pipe and the annular connecting part are integrally formed, the annular connecting part has an axial thickness that is less than a radial thickness of the annular connecting part, the outer pipe has a radial thickness that is greater than a radial thickness of the inner pipe, and a first portion of the outer pipe, which is on an axially upstream side with respect to the annular connecting part, has a radial thickness that is substantially the same as a radial thickness of a second portion of the outer pipe, which is on an axially downstream side with respect to the annular connecting part.

3. A throttle body according to claim 1 or 2, wherein the bore wall part has a cylindrical valve bearing that is integrally formed to rotatably support an end side of a rotation center of the throttle valve, and the cylindrical valve bearing is connected to an internal periphery of the outer pipe via the inner pipe and the annular connecting part.

4. A throttle body according to claim 3, wherein the valve bearing protrudes from the outer periphery of the inner pipe in a direction substantially parallel to the rotation center of the throttle valve, and the bore wall part defines a substantially annular recess that is located around the valve bearing to define an annular space between the outer pipe and the valve bearing.

5. A throttle body according to claim 1 or 2, wherein one of the bore wall part and the outer pipe has a sidewall, to which a motor housing part is integrally formed, and the motor housing part receives a motor that rotates the throttle valve.

6. A throttle body according to claim 1 or 2, wherein the throttle body and the throttle valve are made of a same material.

7. A throttle body according to claim 1 or 2, wherein the annular connecting part connects the outer periphery of the inner pipe and an inner periphery of the outer pipe.

8. A throttle body according to claim 1 or 2, wherein the annular connecting part blocks substantially entirely over the circumferential area of the cylindrical space formed between the inner pipe and the outer pipe.

9. A throttle body according to claim 7, wherein the annular connecting part partially blocks the cylindrical space formed between the inner pipe and the outer pipe.

10. A throttle body according to claim 1 or 2, wherein the inner pipe of the bore wall part has a substantially cylindrical inner periphery that defines an intake air passage through which intake air passes, and the throttle valve opens and closes the intake air passage defined by the inner periphery of the inner pipe of the bore wall part.

11. A throttle body according to claim 1 or 2, wherein the axial thickness of the annular connecting part is less than the minimum thickness of a portion of the outer pipe, which is located in the vicinity of the annular connecting part, in the radial direction thereof.

12. A throttle body according to claim 1 or 2, wherein the axial thickness of the annular connecting part is less than the minimum thickness of a portion of the inner pipe, which is located in the vicinity of the annular connecting part, in the radial direction thereof.

13. A throttle body according to claim 1 or 2, wherein the motor housing part has a substantially cylindrical shape.

* * * * *